US009045840B2

(12) United States Patent
Porter et al.

(10) Patent No.: US 9,045,840 B2
(45) Date of Patent: Jun. 2, 2015

(54) DYNAMIC CURRENT DISTRIBUTION CONTROL APPARATUS AND METHOD FOR WAFER ELECTROPLATING

(75) Inventors: David W. Porter, Sherwood, OR (US); Jonathan D. Reid, Sherwood, OR (US); Frederick D. Wilmot, Gladstone, OR (US)

(73) Assignee: Novellus Systems, Inc., Fremont, CA (US)

( * ) Notice: Subject to any disclaimer, the term of this patent is extended or adjusted under 35 U.S.C. 154(b) by 619 days.

(21) Appl. No.: 13/306,527

(22) Filed: Nov. 29, 2011

(65) Prior Publication Data

US 2013/0134045 A1 May 30, 2013

(51) Int. Cl.

| | |
|---|---|
| ***C25D 17/02*** | (2006.01) |
| ***C25D 21/12*** | (2006.01) |
| ***C25D 17/00*** | (2006.01) |
| ***C25D 17/06*** | (2006.01) |
| ***C25D 17/10*** | (2006.01) |
| ***C25D 17/12*** | (2006.01) |

(52) U.S. Cl.

CPC ..... *C25D 17/001* (2013.01); *C25D 17/002* (2013.01); *C25D 17/007* (2013.01); *C25D 17/06* (2013.01); *C25D 17/10* (2013.01); *C25D 21/12* (2013.01); *C25D 17/12* (2013.01)

(58) Field of Classification Search

CPC .... C25D 17/001; C25D 17/002; C25D 21/12; H01L 21/02697

USPC ..... 205/96, 157; 204/252

See application file for complete search history.

(56) References Cited

U.S. PATENT DOCUMENTS

| | | | | |
|---|---|---|---|---|
| 4,721,601 | A * | 1/1988 | Wrighton et al. | 422/82.03 |
| 5,938,899 | A | 8/1999 | Forand | |
| 5,985,126 | A | 11/1999 | Bleck et al. | |
| 6,126,798 | A * | 10/2000 | Reid et al. | 205/143 |
| 6,156,167 | A | 12/2000 | Patton et al. | |
| 6,179,983 | B1 * | 1/2001 | Reid et al. | 205/96 |
| 6,228,232 | B1 | 5/2001 | Woodruff et al. | |
| 6,402,923 | B1 * | 6/2002 | Mayer et al. | 205/96 |
| 6,569,299 | B1 | 5/2003 | Reid et al. | |

(Continued)

OTHER PUBLICATIONS

Feng et al., "Electroplating Apparatus With Vented Electrolyte Manifold," U.S. Appl. No. 12/337,147, filed Dec. 17, 2008.

(Continued)

*Primary Examiner* — Bryan D. Ripa

(74) *Attorney, Agent, or Firm* — Weaver Austin Villeneuve & Sampson LLP

(57) ABSTRACT

Methods, systems, and apparatus for plating a metal onto a work piece are described. In one aspect, an apparatus includes a plating chamber, a substrate holder, an anode chamber housing an anode, and an ionically resistive ionically permeable element positioned between a substrate and the anode chamber during electroplating. The anode chamber may be movable with respect to the ionically resistive ionically permeable element to vary a distance between the anode chamber and the ionically resistive ionically permeable element during electroplating. The anode chamber may include an insulating shield oriented between the anode and the ionically resistive ionically permeable element, with opening in a central region of the insulating shield.

38 Claims, 10 Drawing Sheets

(56) References Cited

U.S. PATENT DOCUMENTS

| | | | | |
|---|---|---|---|---|
| 6,755,954 | B2 | 6/2004 | Mayer et al. | |
| 6,800,187 | B1 | 10/2004 | Reid et al. | |
| 6,890,416 | B1 | 5/2005 | Mayer et al. | |
| 6,964,792 | B1 * | 11/2005 | Mayer et al. | 427/430.1 |
| 7,316,602 | B2 | 1/2008 | Basol et al. | |
| 7,622,024 | B1 * | 11/2009 | Mayer et al. | 204/198 |
| 8,262,871 | B1 | 9/2012 | Mayer et al. | |
| 2001/0020583 | A1 | 9/2001 | Woodruff et al. | |
| 2002/0020627 | A1 | 2/2002 | Kunisawa et al. | |
| 2004/0084316 | A1 * | 5/2004 | Muranaka | 205/84 |
| 2005/0092610 | A1 | 5/2005 | Moore | |
| 2006/0243598 | A1 | 11/2006 | Singh et al. | |
| 2007/0175752 | A1 | 8/2007 | Yang et al. | |
| 2009/0211900 | A1 | 8/2009 | Rash et al. | |
| 2010/0032310 | A1 | 2/2010 | Reid et al. | |
| 2010/0044236 | A1 | 2/2010 | Mayer et al. | |
| 2010/0116672 | A1 * | 5/2010 | Mayer et al. | 205/97 |
| 2010/0147679 | A1 | 6/2010 | Feng et al. | |
| 2012/0061246 | A1 | 3/2012 | Feng et al. | |

OTHER PUBLICATIONS

Mayer et al., "Plating Method and Apparatus With Multiple Internally Irrigated Chambers," U.S. Appl. No. 12/640,992, filed Dec. 17, 2009.

Reid et al., "Method and Apparatus for Electroplating," U.S. Appl. No. 12/291,356, filed Nov. 7, 2008.

Mayer et al., "Method and Apparatus for Electroplating," U.S. Appl. No. 12/481,503, filed Jun. 9, 2009.

Mayer et al., "Method and Apparatus for Electroplating," U.S. Appl. No. 12/606,030, filed Oct. 26, 2009.

US Office Action, dated Mar. 13, 2013, issued in U.S. Appl. No. 12/879,484.

US Final Office Action, dated Jul. 30, 2013, issued in U.S. Appl. No. 12/879,484.

US Office Action, dated Apr. 10, 2014, issued in U.S. Appl. No. 12/879,484.

US Office Action, dated Aug. 6, 2014, issued in U.S. Appl. No. 12/879,484.

* cited by examiner

DYNAMIC CURRENT DISTRIBUTION CONTROL APPARATUS AND METHOD FOR WAFER ELECTROPLATING

RELATED APPLICATIONS

This application is related to U.S. Pat. No. 6,402,923, which is herein incorporated by reference.

BACKGROUND

One process step used in copper damascene processing for the fabrication of integrated circuits is the formation of a "seed-" or "strike-" layer, which is then used as a base layer onto which copper is electroplated (electrofill). The seed layer carries the electrical plating current from the edge region of the wafer substrate (where electrical contact is made) to all trench and via structures located across the wafer substrate surface. The seed film is typically a thin conductive copper layer. It is separated from an insulating silicon dioxide or other dielectric by a barrier layer. The use of thin seed layers (which may also act simultaneously as copper diffusion barrier layers) which are either alloys of copper or other metals, such as ruthenium or tantalum, has also been investigated. The seed layer deposition process desirably yields a layer which has good overall adhesion, good step coverage (more particularly, conformal/continuous amounts of metal deposited onto the side-walls of an embedded structure), and minimal closure or "necking" of the top of the embedded feature.

To effectively plate a large surface area, a plating tooling makes electrical contact to the conductive seed layer in the edge region of the wafer substrate. There is generally no direct contact made to the central region of the wafer substrate. Thus, for highly resistive seed layers, the potential at the edge of the seed layer is significantly greater than at the central region of the seed layer, which is referred to as the "terminal effect". Without appropriate means of resistance and voltage compensation, this large edge-to-center voltage drop leads to a non-uniform plating thickness distribution, primarily characterized by thicker plating at the wafer substrate edge. This non-uniform plating thickness will be even more pronounced as the industry transitions from 300 mm wafers to 450 mm wafers.

SUMMARY

Methods, apparatus, and systems for plating metals are provided. According to various implementations, a plating apparatus may include a chamber housing a movable anode chamber or a movable shield. The movable anode chamber or the movable shield may be used to mitigate the terminal effect when an electroplating process begins. As the electroplating process proceeds, the movable anode chamber or the movable shield may be moved away from the substrate such that a uniform current density may be obtained across the face of the substrate.

According to one implementation, an apparatus includes a plating chamber, a substrate holder, an ionically resistive ionically permeable element, and an anode chamber housing an anode. The plating chamber is configured to contain an electrolyte while electroplating metal onto a substrate. The substrate holder is configured to hold the substrate and has one or more electrical power contacts arranged to contact an edge of the substrate and to provide electrical current to the substrate during electroplating. The ionically resistive ionically permeable element is positioned between the substrate and the anode chamber during electroplating. The ionically resistive ionically permeable element has a flat surface that is substantially parallel to and separated from a plating face of the substrate. The anode chamber is movable with respect to the ionically resistive ionically permeable element to vary a distance between the anode chamber and the ionically resistive ionically permeable element during electroplating. The anode chamber includes an insulating shield oriented between the anode and the ionically resistive ionically permeable element, with an opening in a central region of the insulating shield.

According to another implementation, an apparatus includes a plating chamber, a substrate holder, an ionically resistive ionically permeable element, and a first insulating disk and a second insulating disk. The plating chamber is configured to contain an electrolyte and an anode while electroplating metal onto a substrate. The substrate holder is configured to hold the substrate such that a plating face of the substrate is positioned at a distance from the anode during electroplating. The substrate holder has one or more electrical power contacts arranged to contact an edge of the substrate and to provide electrical current to the substrate during electroplating. The ionically resistive ionically permeable element is positioned between the substrate and the anode. The ionically resistive ionically permeable element has a flat surface that is substantially parallel to and separated from the plating face of the substrate. The first insulating disk and the second insulating disk are positioned between the ionically resistive ionically permeable element and the anode. The first and the second insulating disks are movable with respect to the ionically resistive ionically permeable element to vary a distance between the disks and the ionically resistive ionically permeable element during electroplating. The first and the second insulating disks include an opening in the central region of each disk.

According to another implementation, a method includes holding a substrate having a conductive seed and/or barrier layer disposed on its surface in a substrate holder of an apparatus. The apparatus includes a plating chamber and an anode chamber housing an anode, the plating chamber containing the anode chamber. The anode chamber includes an insulating shield oriented between the anode and an ionically resistive ionically permeable element, with an opening in a central region of the insulating shield. The surface of the substrate is immersed in an electrolyte solution and proximate the ionically resistive ionically permeable element positioned between the surface and the anode chamber. The ionically resistive ionically permeable element has a flat surface that is parallel to and separated from the surface of the substrate. A current is supplied to the substrate to plate a metal layer onto the seed and/or barrier layer. The anode chamber is moved from a first position to a second position, the second position being located a distance further away from the ionically resistive ionically permeable element than the first position.

According to another implementation, a non-transitory computer machine-readable medium includes program instructions for control of an apparatus. The program instructions include code for holding a substrate having a conductive seed and/or barrier layer disposed on its surface in a substrate holder of an apparatus. The apparatus includes a plating chamber and an anode chamber housing an anode, the plating chamber containing the anode chamber. The anode chamber includes an insulating shield oriented between the anode and an ionically resistive ionically permeable element, with an opening in a central region of the insulating shield. The surface of the substrate is immersed in an electrolyte solution and proximate the ionically resistive ionically permeable element positioned between the surface and the anode chamber. The ionically resistive ionically permeable element has a flat surface that is parallel to and separated from the surface of the substrate. A current is supplied to the substrate to plate a metal layer onto the seed and/or barrier layer. The anode chamber is moved from a first position to a second position, the second position being located a distance further away from the ionically resistive ionically permeable element than the first position.

These and other aspects of implementations of the subject matter described in this specification are set forth in the accompanying drawings and the description below.

DETAILED DESCRIPTION

Figure 1A:
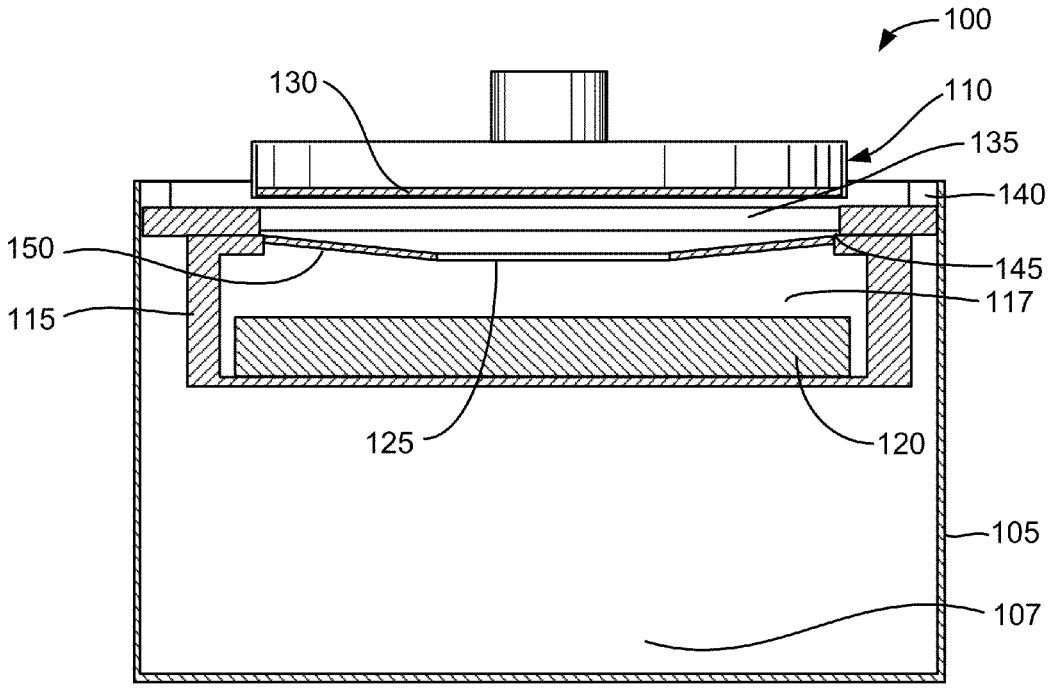
FIGS. 1A and 1B show an example of a cross-sectional schematic diagram of an electroplating apparatus with a movable anode chamber being at one position.

In the following detailed description, numerous specific implementations are set forth in order to provide a thorough understanding of the disclosed methods and apparatus. However, as will be apparent to those of ordinary skill in the art, the disclosed methods and apparatus may be practiced without these specific details or by using alternate elements or processes. In other instances well-known processes, procedures, and components have not been described in detail so as not to unnecessarily obscure aspects of the disclosed methods and apparatus.

In this application, the terms "semiconductor wafer," "wafer," "substrate," "wafer substrate," and "partially fabricated integrated circuit" are used interchangeably. One of ordinary skill in the art would understand that these terms can refer to a silicon wafer during any of many stages of integrated circuit fabrication thereon. The following detailed description assumes the disclosed implementations are implemented on a wafer substrate. However, the disclosed implementations are not so limited. The work piece may be of various shapes, sizes, and materials. In addition to semiconductor wafers, other work pieces that may take advantage of the disclosed implementations include various articles such as printed circuit boards and the like.

Further, in this application, the terms "plating solution," "plating bath," "bath," "electrolyte solution," and "electrolyte" are used interchangeably. One of ordinary skill in the art would understand that these terms can refer to a solution containing metal ions and possibly other additives for plating or electroplating a metal onto a work piece.

Implementations disclosed herein are related to configurations of and methods of using plating tool hardware for control of the electroplating current distribution on a wafer substrate having a high sheet resistance surface. Implementations disclosed herein are applicable to, for example, a 450 millimeter (mm) wafer which is seeded with a thin and resistive seed layer, such as a 5 nanometer (nm) thick copper seed layer having an about 50 Ohms per square (Ohms/square) sheet resistance. One attribute of the disclosed implementations is the ability to achieve a uniform thickness distribution both while plating a metal onto a thin resistive seed layer and during deposition onto a thick metal film.

Achieving a uniform current density across a 450 mm wafer substrate is challenging during the initial stages of damascene copper electroplating. This challenge is generated by the "terminal effect" which refers to the Ohmic resistance drop between a point at which contact is made to a wafer substrate (e.g., generally the edge of the wafer substrate) and the location of plating on the wafer substrate surface. The larger the distances from the contact point, the larger the voltage drop through the seed layer, with lower voltages resulting in slower plating. In the case of 450 mm wafers, the terminal effect is increased compared to, for example, 300 mm wafers, due to the increased distance between the wafer edge where electrical contact is made to a seed layer and the center of the wafer. The terminal effect may be further increased because the seed layer thickness for a 450 mm wafer is expected to decrease to about 5 nm, with a sheet resistance of about 50 Ohms/square. These two factors will result in a large voltage drop between the wafer edge and the wafer center and correspondingly different plating rates at the wafer edge and the wafer center.

Further complicating the problem for the thickness control of the plated metal is that as metal is plated onto a seed layer, the plated metal may increase the conductivity of the layer (i.e., the plated metal on the seed layer) by up to about 1000 times (1000×). Thus, the terminal effect decreases while plating is being performed because of the metal layer that is being plated yields a more uniform voltage across the wafer. This introduces the need for the electroplating hardware to produce a uniform plated metal thickness profile in the case of both large (e.g., at the beginning of an electroplating process) and small (e.g., after metal has been plated onto the seed layer) edge to center voltage decrease from the wafer edge to the wafer center.

Controlling the electroplating current distribution on wafer substrates having high sheet resistance surfaces can be performed using many different techniques. First, an electroplating chamber that incorporates an ionically resistive element having electrolyte-permeable pores or holes, where the element resides in close proximity of the wafer substrate, may aid in mitigating the terminal effect. Some of the ionically resistive ionically permeable elements described herein may present a uniform current density in the proximity of the wafer substrate and therefore serve as virtual anodes. Accordingly, some configurations of an ionically resistive ionically permeable element may also be referred to as a high-resistance virtual anode (HRVA).

HRVAs are effective in obtaining uniformity improvement both during plating on thin seed layers and on thick films. In the case of plating on 450 mm wafers with very thin seed layers, however, the HRVA resistance may be increased dramatically to yield a uniform thickness distribution. This may require hundreds of volts of power and may cause significant plating solution heating during the later portions of plating when a high current is used.

Second, an electroplating chamber that incorporates dynamic shields and bladders may aid in mitigating the terminal effect. Dynamic shields can selectively decrease the current density near the wafer substrate edge when the seed layer is thin and then increase the current density across the face of the wafer substrate to allow uniform plating on thicker metal films. Dynamic shields may be difficult to use in small plating cells, however. Further, dynamic shields may concentrate current near the edge of the shield opening.

Third, an electroplating chamber that incorporates auxiliary cathodes may aid in mitigating the terminal effect. Auxiliary cathodes placed at the outer perimeter of the electroplating chamber, near the edge of the wafer substrate, may be useful in diverting current from the wafer substrate edge. This effect, however, may not extend into more central regions of a wafer substrate. Auxiliary cathodes which are deeper in the plating chamber can divert current from the bulk of the wafer substrate to a greater degree. As the wafer diameter increases to 450 mm, however, it may become ineffective to divert current from the bulk of the wafer to an auxiliary cathode as high currents may be required. Further, placing auxiliary cathodes directly below the face of a wafer substrate may be ineffective due to the very high currents required to selectively divert current from the wafer substrate edge.

Fourth, an electroplating chamber that incorporates multiple anodes may aid in mitigating the terminal effect. Concentric anodes can be used to selectively direct current to specific radial positions on a wafer substrate. This hardware configuration may suffer from drawbacks, however. For example, numerous power supplies may be needed, anode erosion may vary across the wafer substrate making maintenance more frequent, sharp transitions in the current on the wafer substrate may tend to occur at points of transition from one anode to another, and control of the thickness profile on the outer portion of the wafer substrate where terminal effect is the largest may be poor.

Apparatus

All of the above-described techniques may be used to aid in mitigating the terminal effect. Further, in many cases, the above-described techniques can be combined with one another and with other techniques to aid in mitigating the terminal effect. For example, in some implementations, an electroplating apparatus may include three features to mitigate the terminal effect. The first feature may be an auxiliary cathode configured to control the current density at the outer perimeter of the wafer substrate. The second feature may be an ionically conductive ionically resistive element. The third feature may be a movable anode chamber or a movable shield.

For example, a movable anode chamber may include an upwardly sloped top portion made of an insulating material such as plastic, with this top portion including a small opening (e.g., about 200 mm in diameter for a 450 mm wafer), as further described herein. The movable anode chamber may move during plating from a position close to the wafer substrate when the seed layer is thin to a position far from the wafer substrate when metal has been plated onto the wafer substrate. By this motion, the edge of the wafer substrate may be progressively unshielded as the sloped insulating top portion of the movable anode chamber moves away from the wafer substrate.

Figure 1B:
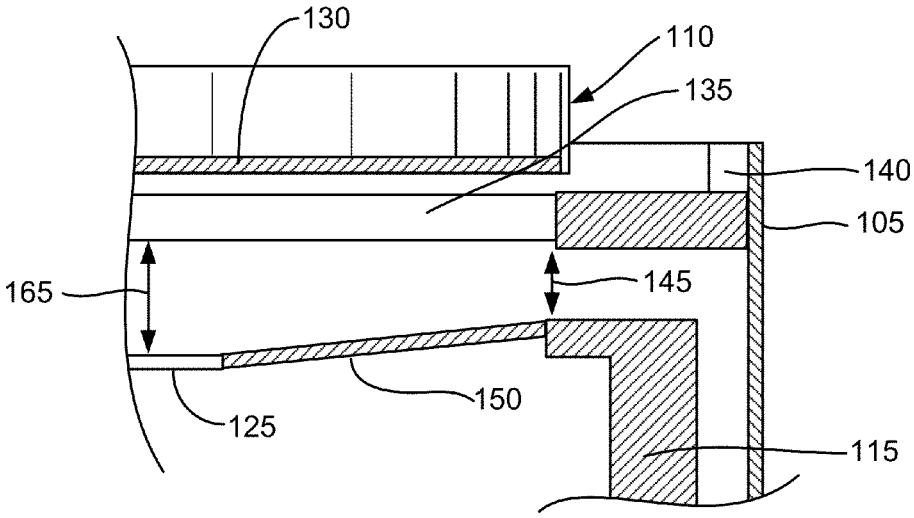

FIGS. 1A and 1B show an example of a cross-sectional schematic diagram of an electroplating apparatus with a movable anode chamber being at one position.

Figure 2:
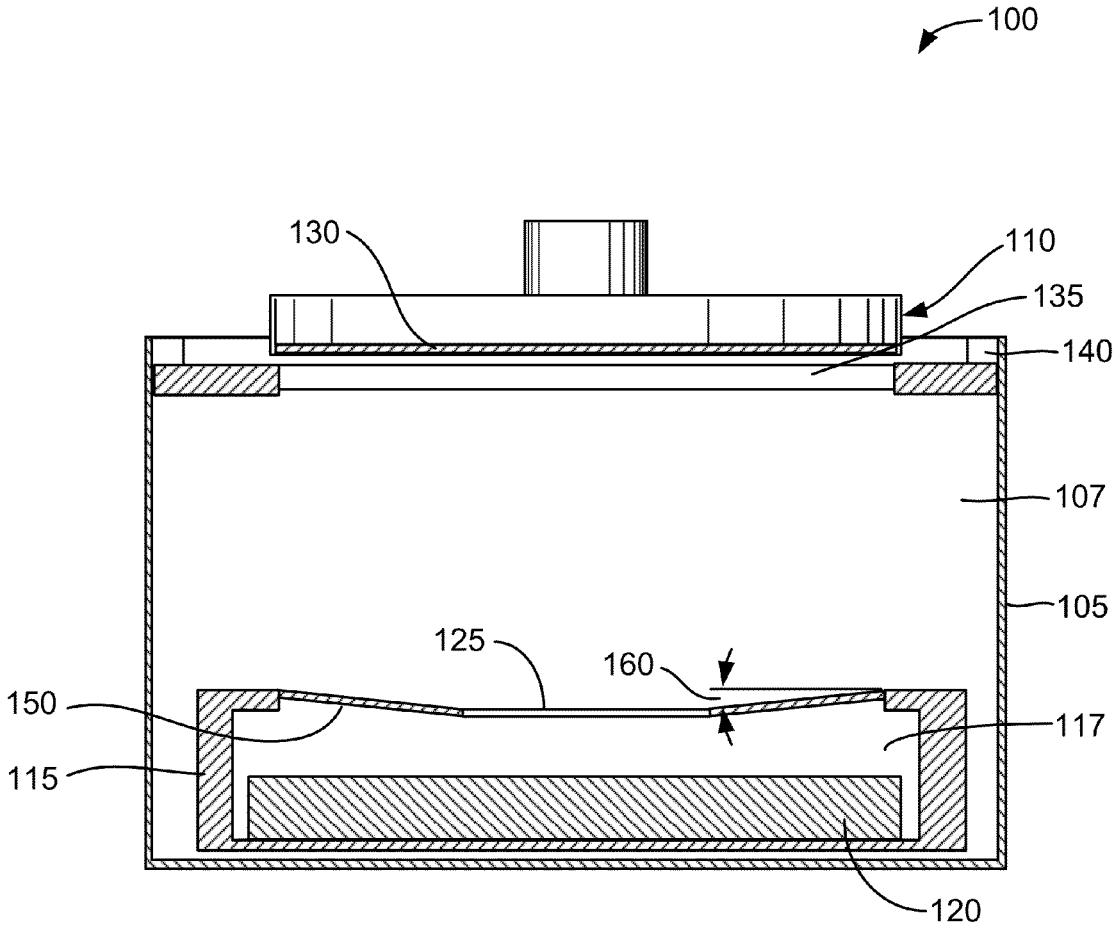
FIG. 2 shows an example of a cross-sectional schematic diagram of an electroplating apparatus with a movable anode chamber being at another position.

FIG. 1B is an enlarged diagram of the upper right hand portion of the electroplating apparatus shown in FIG. 1A. FIG. 2 shows an example of a cross-sectional schematic diagram of an electroplating apparatus with a movable anode chamber being at another position. For example, the movable anode chamber as shown in FIGS. 1A and 1B is at its upper position. The movable anode chamber as shown in FIG. 2 is at its lower position. During an electroplating process, the movable anode chamber may move from its upper position to its lower position.

The electroplating apparatus 100 includes a chamber 105 and the movable anode chamber 115 containing an anode 120. In some implementations, the chamber 105 and the movable anode chamber 115 may be cylindrical to accommodate a circular wafer substrate 130. That is, in a top-down view of the electroplating apparatus 100, the chamber 105 and the movable anode chamber 115 may have circular cross-sections. The electroplating apparatus 100 further includes a substrate holder 110 that is configured to hold the wafer substrate 130 and an ionically conductive ionically resistive element 135 located between the anode chamber 115 and the substrate holder 110.

As shown in FIG. 1, the wafer substrate 130 is immersed in the electrolyte solution (e.g., the catholyte). In some implementations, the substrate holder 110 is a clamshell apparatus which makes contacts to the periphery of the wafer substrate 130 through a number of contact fingers housed behind an elastic "lip seal." The elastic lip seal serves to seal the clamshell and to keep the edge contact region and wafer backside substantially free of electrolyte, as well as to avoid any plating onto the contacts.

A clamshell apparatus is composed of two major pieces. The first piece of the clamshell is the cone. The cone can open, allowing for the insertion and the extraction of the wafer. The cone also applies pressure to the contacts and the seal. The second piece of the clamshell is the wafer holding cup. The bottom of the cup is generally made of (or coated with) an insulator to avoid any coupled corrosion and electrodeposition reaction which would occur, for example, on a metal that is placed into the electrolyte solution with a laterally varying potential, as is the case here. At the same time, however, the cup bottom needs to be mechanically strong (e.g., to press the cup up against the wafer and cone and avoid flexing) and thin (e.g., to avoid electrolyte flow disturbances near the wafer edge). Therefore, in some implementations, the cup bottom is a metal that is coated with an insulating material such as glass or plastic. A general description of a clamshell-type plating apparatus having aspects suitable for use with implementations disclosed herein is described in further detail in U.S. Pat. No. 6,156,167 and U.S. Pat. No. 6,800,187, which are both incorporated herein by reference.

In some implementations, the ionically conductive ionically resistive element 135 is a high-resistance virtual anode (HRVA). The HRVA may be about 0.25 inches to 1 inch thick, or about 0.5 inches thick. The open area of the HRVA may be about 1% to 2%. A HRVA with such an open area and an about 0.5 inch thickness may increase the electrolyte resistance across the volume that the HRVA occupies by about 50 times to 100 times (50× to 100×). Further details of implementations of the ionically conductive ionically resistive element 135 are given below.

An auxiliary cathode 140 is positioned along the perimeter of the chamber 105 and around the perimeter of the wafer substrate 130. The auxiliary cathode 140 is also referred to as a thief cathode. The auxiliary cathode 140 may draw plating current from the adjacent edges of the wafer substrate 130 during an electroplating process. For example, the auxiliary cathode may reduce plating current at the edge (e.g., about 10 mm to 20 mm) of the wafer substrate when combined with the impact of the long resistive path though electrolyte generated by the narrow pathway between the movable anode chamber opening and the HRVA plate (described further, below). In some implementations, the auxiliary cathode 140 may be controlled with an independent power supply. Further details of implementations of an auxiliary cathode are given below.

The movable anode chamber 115 may be fabricated from an insulating material, such as a polymeric material or a plastic, for example. Such materials include polypropylene, high-density polyethylene (HDPE), and polyvinylidene fluoride (PVDF), for example. In some implementations, the anode chamber or pieces of the anode chamber may be machined from a polymeric material or a plastic. When the anode chamber is fabricated from different pieces a polymeric material or a plastic, the pieces of the anode chamber may be joined with a plastic welding process, for example.

The movable anode chamber 115 may further include an insulating shield 150. The insulating shield 150 also may be fabricated from an insulating material, such as a polymeric material or a plastic (e.g., polypropylene, high-density polyethylene (HDPE), and polyvinylidene fluoride (PVDF)), for example. The opening in the insulating shield 150, with the opening including a cationic membrane 125, may be about 10% to 30% of an area of the face of a wafer substrate 130, in some implementations. For example, for a 450 mm diameter wafer substrate, the opening of in the insulating shield 150 may be about 140 mm to 250 mm in diameter, or about 200 mm in diameter. The size of the opening in the insulating shield determines in part the degree of terminal effect compensation provided by the movable anode chamber 115. For example, small openings in the insulating shield 150 will result in terminal effect compensation across a larger part of the wafer substrate due to the longer resistive path toward the wafer edge.

The chamber 105, while containing the movable anode chamber 115, may contain a different electrolyte solution than the movable anode chamber 115, in some implementations. For example, the chamber 105 may contain a first electrolyte solution 107, sometimes referred to as a catholyte. The movable anode chamber 115 may contain a second electrolyte solution 117, sometimes referred to as the anolyte. In some implementations, the anolyte may have a similar composition as the catholyte, but exclude additives such as accelerators, levelers, and/or suppressors, for example. The two electrolyte solutions may be separated by the cationic membrane 125 associated with the movable anode chamber 115. In some other implementations, the chamber 105 and the movable anode chamber 115 may contain the same electrolyte solution.

The cationic membrane 125 allows for ionic communication between the movable anode chamber 115 and the chamber 105, while preventing the particles generated at the anode 120 from entering the proximity of the wafer substrate 130 and contaminating it. The cationic membrane 125 may also be useful in prohibiting non-ionic and anionic species such as bath additives from passing though the membrane and being degraded at the anode surface, and to a lesser extent in redistributing current flow during the plating process and thereby improving the plating uniformity. Detailed descriptions of suitable ionic membranes are provided in U.S. Pat. Nos. 6,126,798 and 6,569,299, both incorporated herein by reference. Further description of suitable cationic membranes is provided in U.S. patent application Ser. No. 12/337,147, titled "Electroplating Apparatus With Vented Electrolyte Manifold," filed Dec. 17, 2008, incorporated herein by reference. Yet further detailed description of suitable cationic membranes is provided in U.S. patent application Ser. No. 12/640,992, titled "PLATING METHOD AND APPARATUS WITH MULTIPLE INTERNALLY IRRIGATED CHAMBERS," filed Dec. 17, 2009, incorporated herein by reference.

In some implementations, the anode 120 may be a disk of material having a diameter similar to the diameter of the wafer substrate 130. For example, the diameter of the anode 120 may be about 450 mm when the wafer substrate 130 has a diameter of about 450 mm. The thickness of the anode 120 may be about 4 cm to 8 cm, or about 6 cm. In some implementations, the anode may include pieces of a disk of material such that the disk may be easily replaced. In some other implementations, the anode may be small spheres or pieces of material that fill a similar space that a disk would. For example, the anode may be spheres of material with a diameter of about 0.5 cm to 2.5 cm, or about 1.5 cm.

As noted above, the movable anode chamber 115 can move from an upper position (e.g., as shown in FIGS. 1A and 1B) to a lower position (e.g., as shown in FIG. 2) during an electroplating process. The distance between the upper position and the lower position may about 2 centimeters (cm) to 20 cm, in some implementations. For example, the movable anode chamber 115 may move in the chamber 105 about 2 cm to 20 cm to vary the distance between the movable anode chamber 115 and the ionically conductive ionically resistive element 135. In some other implementations, the distance between the upper position and the lower position may about 2 cm, about 10 cm, or about 8 cm to 20 cm.

When the movable anode chamber 115 is in its upper position, it may be close to the wafer substrate 130, with the ionically conductive ionically resistive element 135, which may be directly below the wafer substrate 130, being between the wafer substrate 130 and the movable anode chamber 115. In some implementations, a distance between the face of the ionically conductive ionically resistive element 135 facing the wafer substrate 130 and the face of the wafer substrate 130 may be about 1 mm to 8 mm. In some implementations, smaller distances may be difficult to control.

In some implementations, the insulating shield 150 may be substantially flat and substantially parallel to the face of the ionically conductive ionically resistive element 135 it faces. In some other implementations, the insulating shield 150 may angle downwards from its outer perimeter to its inner perimeter, with the inner perimeter defining the opening. For example, the angle 160 the insulating shield 150 makes with a horizontal plane may be about 0 degrees to 30 degrees, or about 15 degrees, in some implementations. That is, in some implementations, the insulating shield 150 may form a truncated cone (a truncated cone is the result of cutting a cone by a plane parallel to the base and removing the part containing the apex). In some implementations, the insulating shield being angled or sloped may aid in compensating for the terminal effect related to seed layer resistance. An insulating shield 150 with lower angles to a horizontal plane combined with a closer spacing to the ionically conductive ionically resistive element 135 yields a stronger compensation of Ohmic voltage drops through the seed layer, in some implementations. In some other implementations, the insulating shield 150 may have a complex shape such as an initially high angle near the wafer center and a more gradual slope near the wafer edge.

In some implementations, the distance 145 between the ionically conductive ionically resistive element 135 and the anode chamber 115 edge (e.g., or the outer perimeter of the insulating shield 150) may be on the order of a few millimeters when the anode chamber 115 is in its upper position. In some other implementations, the distance 145 may be about 1 mm to 10 mm. In some implementations, when the insulating shield 150 is substantially flat and substantially parallel to the face of the ionically conductive ionically resistive element 135 and when the anode chamber 115 is in its upper position, a distance 165 between the ionically conductive ionically resistive element 135 and the anode chamber 115 (e.g., or the inner perimeter of the insulating shield 150 or the cationic membrane 125) may be on the order of a few millimeters or about 1 mm to 10 mm. In some other implementations, when the insulating shield 150 includes a sloped portion or portions, the distance 165 may be about 3 mm to 50 mm or about 20 mm to 30 mm.

With the movable anode chamber 115 having an opening at its center, as defined by insulating shield 150 with the cationic membrane 125, there is a long path through the electrolyte to the ionically conductive ionically resistive element 135 near the edge of the wafer substrate 130. This long path has a relatively high electrical resistance and thereby inhibits current flow to the edge of the wafer substrate 130. In effect, the high resistance through the electrolyte between the opening in the movable anode chamber 115 (when the movable anode chamber is in its upper position) and the ionically conductive ionically resistive element 135 counteracts the high resistance through the seed layer from the wafer substrate edge to the wafer substrate center. In some implementations, the auxiliary cathode 140 also may be used when electroplating on a resistive seed layer when the anode chamber 115 is at its upper position to further aid in mitigating the terminal effect. When the distance between the face of the ionically conductive ionically resistive element 135 facing the wafer substrate 130 and the face of the wafer substrate 130 is large (e.g., greater than about 8 mm), however, the impact of the ionically conductive ionically resistive element 135 and the anode chamber 115 in its upper position may be degraded.

Thus, with the movable anode chamber 115 being at its upper position as shown in FIGS. 1A and 1B, the terminal effect due to resistive seed layers may be counterbalanced. The terminal effect diminishes, however, as the metal thickness increases during an electroplating process. With the terminal effect diminishing, the movable anode chamber 115 being at its upper position may result in a thick metal layer at the center of the wafer substrate, which is not desired.

Therefore, when the terminal effect due to a thin resistive seed layer begins to diminish due to a metal being plated onto the seed layer, the anode chamber 115 may be moved away from the ionically conductive ionically resistive element 135. As electroplating onto the seed layer progresses, the anode chamber 115 may be moved further and further away from the ionically conductive ionically resistive element 135 until the anode chamber 115 is at its lower position, as shown in FIG. 2. When the anode chamber 115 is at its lower position, the path through the electrolyte from the opening in the insulating shield 150 to both the wafer substrate edge and the wafer substrate center approaches the same value. Small differences in this path may become negligible due to the resistance of the ionically conductive ionically resistive element 135, for example. Any type of mechanism may be used to move the movable anode chamber 115 to different positions in the chamber 105. In some implementations, a pneumatic mechanism or a mechanical mechanism may be used.

In some implementations, the rate of movement of the anode chamber 115 may be faster at the start of a plating process than at later stages in the plating process. This may be due to large changes in the seed layer conductivity at the beginning of the plating process. That is, when a plating process starts, the seed layer conductivity may initially increase rapidly as metal is plated onto the seed layer, and then increase at a slower rate as additional metal is plated. For example, in some implementations, the anode chamber 115 may move at a rate of about 0.5 centimeters per second (cm/s) to 2 cm/s in the first few seconds of plating. In some implementations, the anode chamber 115 may move at a rate of about 0.1 cm/s to 0.5 cm/s after the first few seconds or after the first 5 seconds of plating.

In some implementations, the current applied to the auxiliary cathode 140 may be coordinated with the movement of the anode chamber 115 so that a uniform current density across the wafer substrate 130 is maintained as metal is plated onto the wafer substrate 130. Generally, the current applied to the auxiliary cathode 140 decreases in conjunction with movement of the anode chamber 115 away from the ionically conductive ionically resistive element 135. In some implementations, the auxiliary cathode 140 may not be used when electroplating on thick metal films when the anode chamber 115 is at its lower position. The auxiliary cathode 140 may be used, however, when the anode chamber 115 is at its lower position when a thin layer of metal at the wafer substrate edge is desired.

For example, in some implementations, the anode chamber may be in its upper position when electroplating copper onto a 0 nm to 5 nm thick copper seed layer or onto a combination of copper seed layer and copper plated layer. A layer of copper 0 nm to 5 nm thick may have a sheet resistance of about 50 Ohms/square to 5 Ohms/square or about 50 Ohms/square to 10 Ohms/square. As the copper electroplating process progresses, the anode chamber may move linearly with time to about 2 cm to 4 cm below its upper position while the next about 10 nm of copper is being deposited. The movement of the anode chamber from the upper position to about 2 cm to 4 cm below the upper position may take place in the first few seconds after the electroplating process begins. The sheet resistance of the copper layer may be about 2 Ohms/square at this point in the process. As the copper electroplating process continues, the anode chamber may move linearly with time to about 8 cm to 20 cm below its upper position while the next about 30 nm of copper is being deposited. The sheet resistance of the copper layer may be about 0.4 Ohms/square at this point in the process. The anode chamber may reach its lower position when the plated copper thickness is greater than about 50 nm.

In some implementations, the current density may be lower (e.g., about 3 to 10 milliamps per square centimeter (mA/$cm^2$)) during the initial stages of plating with the anode chamber in its upper position compared to later stages of plating. In some implementations, the current density may be about 30 to 50 mA/$cm^2$ in the later stages of plating when the anode chamber is at its lower position.

In summary, when a movable anode chamber with an opening in the insulating shield is at its upper position, the wafer substrate edges may be isolated from the anode. When the movable anode chamber is at its lower position, electroplating onto a thick metal layer may be uniform rather than a center-thick profile. The movable anode chamber may be combined with an ionically conductive ionically resistive element and an auxiliary cathode to effectively compensate for the terminal effect, in some implementations.

In some other implementations, a cationic membrane may not be associated with the movable anode chamber and may instead be located below the ionically conductive ionically resistive element. Thus, the distance 145 between the anode chamber 115 and ionically conductive ionically resistive element 135 may be determined, in some implementations, in part by this cationic membrane. In these implementations, the cationic membrane may include slopes and/or angles to match the insulating shield (e.g., when the insulating shield includes slopes and/or angles). Further, in these implementations, the electrolyte below the cationic membrane may be shared with the anode chamber when there is not another membrane in the opening of the insulting shield of the anode chamber.

In some other implementations, an electroplating apparatus may include a movable shield instead of a movable anode chamber. A movable shield may be combined with other techniques aid in mitigating the terminal effect. For example, in some implementations, an electroplating apparatus may include an auxiliary cathode, an ionically resistive ionically conductive element, and a movable shield.

Figure 3:
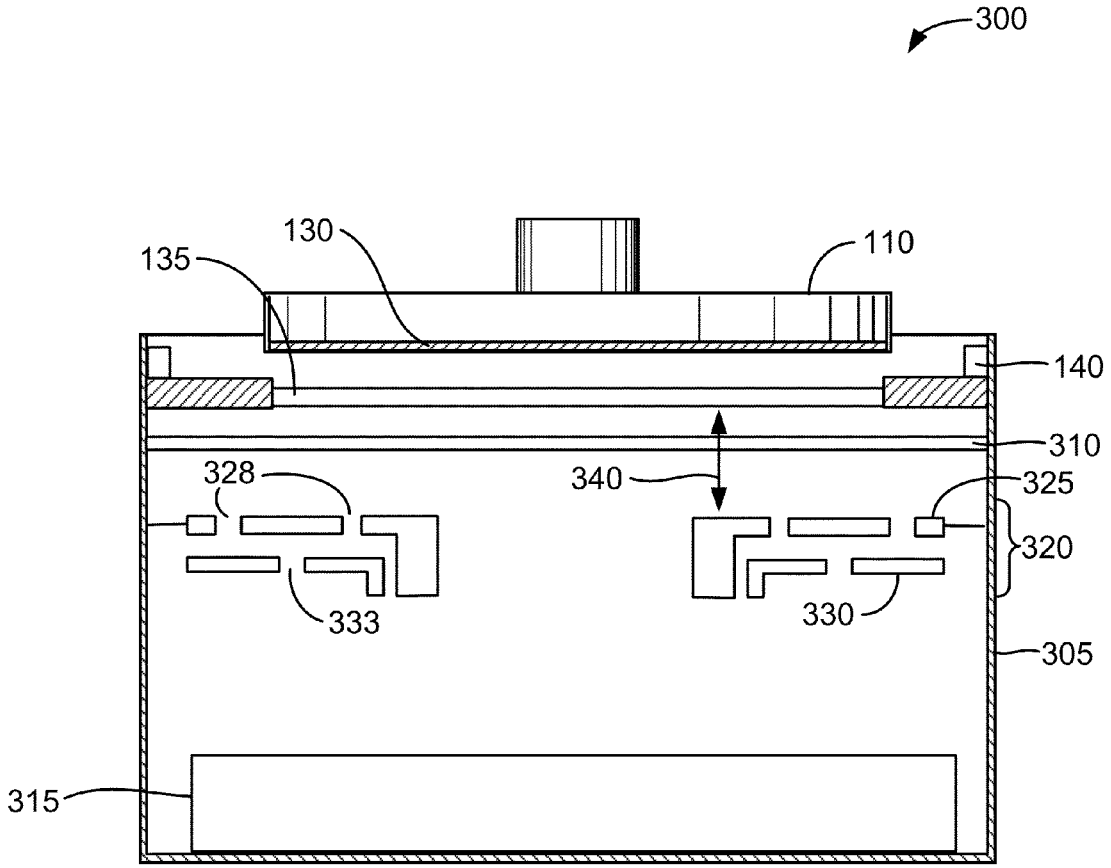
FIG. 3 shows an example of a cross-sectional schematic diagram of an electroplating chamber with a movable shield being at one position.

FIG. 3 shows an example of a cross-sectional schematic diagram of an electroplating apparatus with a movable shield. Similar to the electroplating apparatus 100 shown in FIGS. 1A, 1B, and 2, the electroplating apparatus 300 includes a chamber 305 and a substrate holder 110 that is configured to hold a wafer substrate 130. An ionically conductive ionically resistive element 135 may be located between an anode 315 and the substrate holder 110. An auxiliary cathode 140 may be positioned along the perimeter of the chamber 305 and around the perimeter of the wafer substrate 130.

Figure 4A:
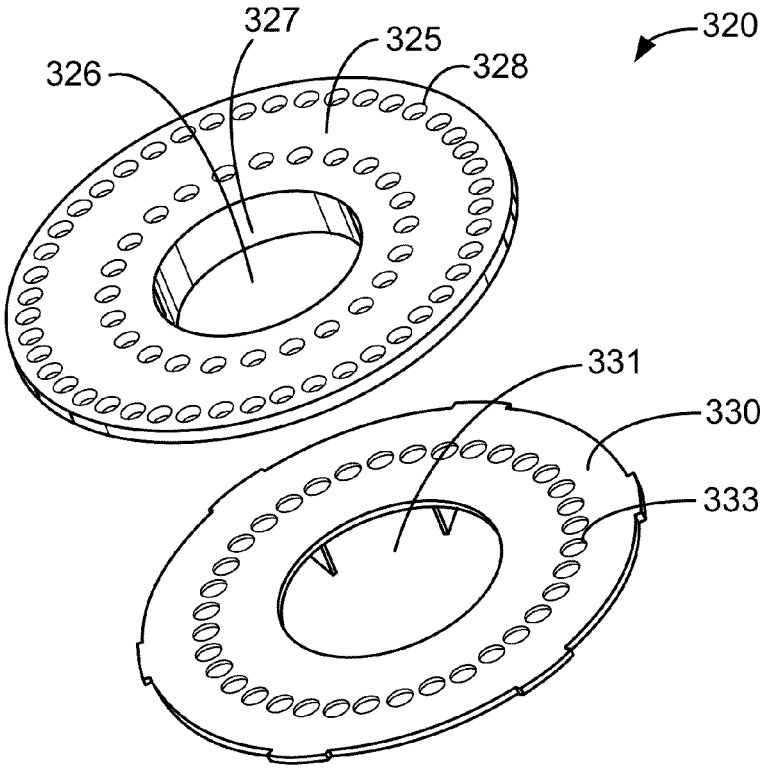
FIGS. 4A and 4B show examples of isometric projections of a movable shield.
Figure 4B:
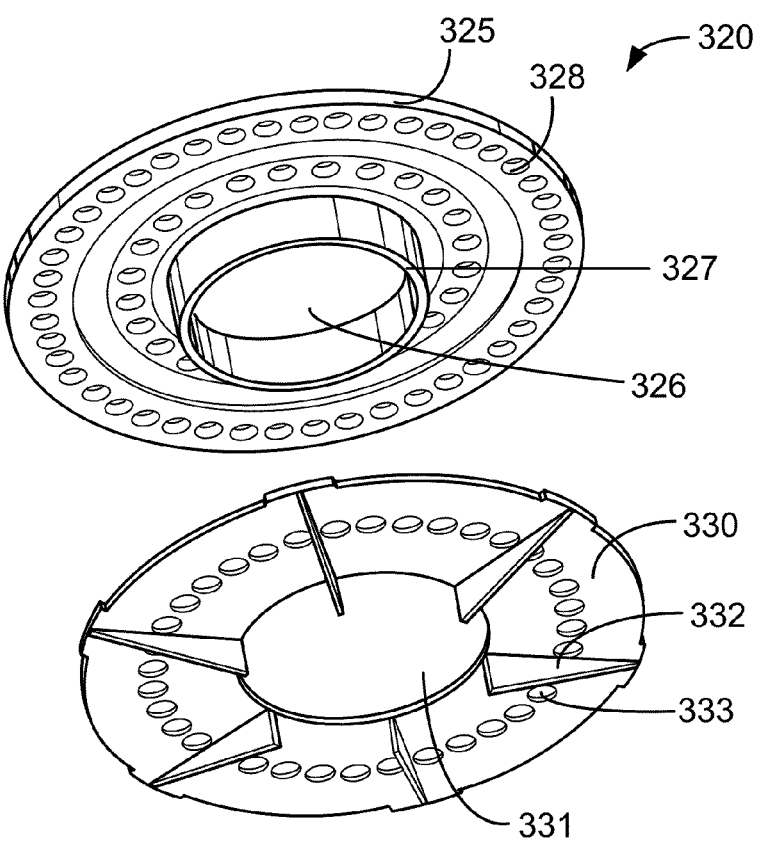

The electroplating apparatus 300 further includes a movable shield 320 positioned between the ionically resistive ionically permeable element 135 and the anode 315. In some implementations, the movable shield may include two insulating disks 325 and 330. FIGS. 4A and 4B show examples of isometric projections of the movable shield 320. FIG. 4A shows a top-down view, and FIG. 4B shows a bottom-up view.

In some implementations, the electroplating apparatus 300 includes a cationic membrane 310 separating the chamber 305 into a catholyte chamber and an anolyte chamber containing the anode 315. While the cationic membrane 310 in the electroplating apparatus 300 is located above a movable shield 320 (i.e., the movable shield is in the anolyte chamber), in some implementations, the cationic membrane 310 may be located below the movable shield 320 (i.e., the movable shield is in the catholyte chamber).

In some implementations, the anode 315 may be a disk of material having a diameter similar to the diameter of the wafer substrate 130. For example, the diameter of the anode 315 may be about 450 mm when the wafer substrate 130 has a diameter of about 450 mm. The thickness of the anode 315 may be about 4 cm to 8 cm, or about 6 cm. In some implementations, the anode may include pieces of a disk of material such that the disk may be easily replaced. In some other implementations, the anode may be small spheres of pieces of material that fill a similar space that a disk would. For example, the anode may be spheres of material with a diameter of about 0.5 cm to 2.5 cm, or about 1.5 cm.

The first insulating disk 325 of the movable shield 320 includes an opening 326, and the second insulating disk 330 includes an opening 331. The openings 326 and 331 are in the central regions of the insulating disks 325 and 330, respectively. An area of the openings 326 and 331 in the first and the second insulating disks 325 and 330 may be about 10% to 30% of an area the plating face of the substrate, in some implementations. The first insulating disk 325 may include a flange 327 that fits within the opening 331 of the second insulating disk 330. The second insulating disk 330 may include a plurality of ridges 332 to increase the rigidity of the insulating disk. Each insulating disk may be about 0.5 cm to 2 cm thick, or about 1.3 cm thick. The outer diameter of each insulating disk may be slightly larger than a diameter of the wafer substrate that is to be plated in the electroplating apparatus. For example, for a 450 mm diameter wafer, the outer diameter of each insulating disk may be about 460 mm to 500 mm, or about 480 mm. The insulating disks may be made out of an insulating material, such as a polymeric material or a plastic, for example. Such materials include polyphenylene sulfide (PPS), polyethylene terephthalate (PET), polycarbonate, clear polyvinyl chloride (PVC), polypropylene, polyvinylidene fluoride (PVDF), and polytetrafluoroethylene (PTFE), for example.

The first insulating disk 325 may include a plurality of holes 328, and the second insulating disk 330 also may include a plurality of holes 333. When the first insulating disk 325 and the second insulated disk 330 are in contact with one another or located close to one another, no fluid (e.g., electrolyte) may be able to flow though the plurality of holes 328 and 333 due to the holes in each of the disks being offset from one another. When the first insulating disk 325 and the second insulated disk 330 are separated from one another by a small distance, however, fluid (e.g., electrolyte) may be able to flow though the plurality of holes 328 and 333. The distance of separation needed for a fluid to be able to flow though the plurality of holes 328 and 333 may be about 0.5 mm to 2 mm, in some implementations.

The movable shield 320 may have an upper position and a lower position in the chamber 305. In some implementations, a distance 340 between the ionically conductive ionically resistive element 135 and the first insulating disk 325 may be on the order of a few millimeters when the movable shield 320 is in its upper position. In some other implementations, the distance 340 may be about 1 mm to 10 mm. The movable shield 320 may be about 12 cm to 21 cm or about 15 cm to 18 cm from the anode 315 when the movable shield 320 is in its upper position. The distance between the upper position and the lower position of the movable shield may be about 5 cm to 15 cm, or about 10 cm. The movable shield 320 may be about 2 cm to 11 cm or about 5 cm to 8 cm from the anode 315 when the movable shield 320 is in its lower position.

When the movable shield 320 is in its upper position, the first and the second insulating disks 325 and 330 may be close to one another such that no electrolyte is able to flow through the plurality of holes 328 and 333. In this configuration, the terminal effect due to a thin resistive seed layer on a wafer substrate may be counterbalanced because of the long path through the electrolyte from the anode 315 to the edge of the wafer substrate 130 (i.e., the path from the anode must pass through the central openings 326 and 331 in the first and the second insulating disks 325 and 330). This long path may have a relatively high electrical resistance and thereby inhibit current flow to the edge of the wafer substrate 130. In effect, the high resistance through the electrolyte between central openings 326 and 331 in the insulating disks 325 and 330 and the ionically conductive ionically resistive element 135 may counteract the high resistance through the seed layer from the wafer substrate edge to the wafer substrate center.

The terminal effect diminishes, however, as the metal thickness increases during electroplating. With the terminal effect diminishing, the movable shield 320 being at its upper position may result in a thick metal layer at the center of the wafer substrate, which is not desired.

Thus, when the terminal effect due to a thin resistive seed layer begins to diminish due to a metal being plated onto the seed layer, the movable shield 320 may be moved away from the ionically conductive ionically resistive element 135. As electroplating onto the seed layer progresses, the movable shield 320 may be moved further and further away from the ionically conductive ionically resistive element 135 until the movable shield 320 is at its lower position. As the movable shield 320 is moved from its upper position to its lower position, the first and the second insulating disks 325 and 330 may be separated from one another by an increasing distance as the movable shield 320 moves down. When the movable shield 320 is at its lower position, the first and the second insulating disks 325 and 330 may be separated from one another by about 0.5 mm to 10 mm. Any type of mechanism may be used to move the movable shield to different positions in the chamber. In some implementations, a pneumatic mechanism or a mechanical mechanism may be used.

Thus, as the movable shield 320 moves from its upper position to its lower position, a larger amount of electrolyte may permitted to flow though the plurality of holes 328 and 333 in each of the insulating disks 325 and 330. This allows for alternate electrically conductive paths though the electrolyte (i.e., through the plurality holes in the insulating disks) as metal is plated onto the wafer substrate and the terminal effect diminishes. By the motion of the movable shield 320 and by the motion insulating disks 325 and 330 relative to one another (i.e., to allow electrolyte to flow through the plurality of holes), the edge of the wafer substrate may be progressively unshielded, allowing for an even current distribution across the face of the wafer substrate when plating onto a thicker metal layer.

In some implementations, the rate of movement of the movable shield 320 may be faster at the start of a plating process than at later stages in the plating process. This may be due to large changes in the seed layer conductivity at the beginning of the plating process. That is, when a plating process starts, the seed layer conductivity may initially increase rapidly as metal is plated onto the seed layer, and then increase at a slower rate as additional metal is plated. For example, in some implementations, the movable shield 320 may move at a rate of about 0.5 centimeters per second (cm/s) to 2 cm/s in the first few seconds of plating. In some implementations, the movable shield 320 may move at a rate of about 0.1 cm/s to 0.5 cm/s after the first few seconds or after the first 5 seconds of plating.

For example, in some implementations, the movable shield may be is its upper position when electroplating copper onto a 0 nm to 5 nm thick copper seed layer or a combination of copper seed layer and copper plated layer. A layer of copper 0 nm to 5 nm thick may have a sheet resistance of about 50 Ohms/square to 5 Ohms/square or about 50 Ohms/square to 10 Ohms/square. As the copper electroplating process progresses, the movable shield may move linearly with time to about 0.1 cm to 5 cm below its upper position while the next about 10 nm of copper is being deposited. The sheet resistance of the copper layer may be about 2 Ohms/square at this point in the process. As the copper electroplating process continues, the movable shield may move linearly with time to about 3 cm to 10 cm below its upper position while the next about 30 nm of copper is being deposited. The sheet resistance of the copper layer may be about 0.4 Ohms/square at this point in the process. The movable shield may reach its lower position when the plated copper thickness is greater than about 50 nm.

As noted above, as the movable shield is moved from its upper position to its lower position, the distance between the first and the second insulating disks may be increased. For example, at the upper position of the movable shield, the insulating disks may be positioned with respect to one another such that electrolyte cannot flow though the plurality of holes. At the lower position of the movable shield, the insulating disks may be positioned at a distance from one another such that electrolyte can flow though the plurality of holes. The separation between the first and the second insulating disks may be increased linearly with time, in some implementations.

In some other implementations, instead of the first and the second insulating disks allowing the flow of electrolyte through the plurality of holes as the disks are separated from one another, the disks may be rotated with respect to one another to allow for the flow of electrolyte through the plurality of holes. For example, when the first and the second insulating disks are at one position with respect to one another, a plurality of holes in the first insulating may not overlap with a plurality of holes in the second insulating disk. When the first and the second insulating disks are rotated to another position with respect to one another, however, the plurality of holes in the first insulating may overlap with the plurality of holes in the second insulating disk such that a fluid is able to flow though the plurality of holes.

In further implementations, the first and the second insulating disks may be associated with a movable anode chamber. For example, the movable anode chamber described with respect to FIGS. 1A, 1B, and 2 may include the first and the second insulating disks described with respect to FIGS. 3 and 4, with the insulating disks replacing the insulating shield. A plating chamber with such an anode chamber may provide for further mitigation of the terminal effect, in some implementations.

The apparatus described herein may include hardware for accomplishing the process operations, as described above, and also include a system controller (not shown) having instructions for controlling process operations in accordance with the disclosed implementations. The system controller may include one or more memory devices and one or more processors configured to execute the instructions so that the apparatus can perform a method in accordance with the disclosed implementations. Machine-readable media containing instructions for controlling process operations in accordance with the disclosed implementations may be coupled to the system controller.

Structure of the Tonically Conductive Tonically Resistive Element

In some implementations, the ionically resistive ionically permeable element is a microporous plate or disk having a continuous three-dimensional network of pores (e.g., plates made of sintered particles of ceramics or glass). For example, a porous plate has a three-dimensional pore network including intertwining pores through which ionic current can travel both vertically up through the disk in the general direction of the anode to wafer substrate, as well as laterally (e.g., from the center to the edge of the disk). Examples of suitable designs for such plates are described in U.S. Pat. No. 7,622,024, which is herein incorporated by reference.

In some other implementations, through-holes are provided in the ionically resistive ionically permeable element to form channels that do not substantially communicate with one another within the body of the element, thereby minimizing lateral movement of ionic current in the element. Current flows in a manner that is one-dimensional, substantially in the vector direction that is normal to the closest plated surface near the resistive element.

The ionically resistive ionically permeable element having 1-D through-holes (also referred to as a HRVA or a 1-D porous HRVA) is sometimes a disk (other shapes may also be used) made of an ionically resistive material having a plurality of holes drilled (or otherwise made) through it. The holes do not form communicating channels within the body of the disk and generally extend through the disk in a direction that is substantially normal to the surface of the wafer. A variety of ionically resistive materials can be used for the disk body, including but not limited to polycarbonate, polyethylene, polypropylene, polyvinylidene diflouride (PVDF), polytetrafluoroethylene, polysulphone, and the like. The disk materials may be resistant to degradation in acidic electrolyte environment, relatively hard, and easy to process by machining.

In some implementations, the ionically resistive element is a HRVA having a large number of isolated and unconnected ionically permeable through-holes (e.g., a resistive disk having multiple perforations or pores allowing for passage of ions) in close proximity to the work piece, thereby dominating or "swamping" the overall system's resistance. When sufficiently resistive relative to the wafer sheet resistance, the element can be made to approximate a uniform distribution current source. By keeping the work piece close to the resistive element surface, the ionic resistance from the top of the element to the surface is much less than the ionic path resistance from the top of the element to the work piece edge, compensating for the sheet resistance in the thin metal film and directing a significant amount of current over the center of the work piece. Some benefits and details associated with using an ionically resistive ionically permeable element in close proximity of the substrate are discussed in detail in the U.S. Pat. No. 7,622,024, which is herein incorporated by reference.

Regardless of whether the ionically resistive ionically permeable element permits one or more dimensional current flow, it is preferably co-extensive with the wafer substrate, and therefore has a diameter that is generally close to the diameter of the wafer that is being plated. Thus, for example, the element diameter may be about 150 mm and 450 mm, with an about 200 mm element being used for a 200 mm wafer, an about 300 mm element for a 300 mm wafer, and an about 450 mm element for a 450 mm wafer, and so forth. In those instances where the wafer has a generally circular shape but has irregularities at the edge, e.g., notches or flat regions where wafer is cut to a chord, a disk-shaped element can still be used, but other compensating adjustments can be made to the system, as described in U.S. patent application Ser. No. 12/291,356, filed Nov. 7, 2008.

In some implementations, the element has a diameter that is greater than the diameter of the wafer to be plated (e.g., greater than 200 mm, 300 mm, or 450 mm), and has an outer edge portion that is hole-free (in the case of a one-dimensional HRVA). Such edge portion can be used to create a small gap about the periphery of the wafer (a peripheral gap between the HRVA edge portion and either the wafer edge or the bottom of wafer-holding cup), and to assist in mounting the HRVA within the chamber, e.g., to a chamber wall. In some implementations the size of the hole-free HRVA edge is about 5 mm to 50 mm from the outer edge of the HRVA to the edge of the portion of the HRVA that has holes.

In the case of a one-dimensional HRVA, the number of through-holes made in the disk may be relatively large, but the diameter of each hole may be quite small. Generally, the diameter of each hole generally is less than about ¼ of the HRVA to wafer gap. In some implementations, the number of holes is about 6,000 to 12,000, with each hole (or at least 95% of holes) having a diameter (or other principal dimension) of less than about 1.25 mm. In some implementations, the thickness of the HRVA may be about 5 mm to 50 mm, e.g., about 10 mm to 25 mm. In some implementations, a HRVA may be about 5% porous or less.

In some other implementations, it may be advantageous to use a HRVA having regions with non-uniform distributions of holes, or with holes that are blocked such that the wafer experiences a non-uniform hole distribution. Such a hole distribution may permanently direct more current to the center of the wafer, such that a high resistance seed layer is more uniformly plated than if a uniform hole distribution is used. A thick film (i.e., with a low sheet resistance), however, will tend to plate more non-uniformly if a non-uniform hole distribution is used. The blocked or missing holes may be non-uniform in the radial, azimuthal, or both directions. In some implementations, the ionically resistive ionically permeable element is positioned substantially parallel to the wafer and anode surface, and the one-dimensional through-holes are oriented parallel to the direction between the wafer and anode surface. In some other implementations, at least some of the holes have their relative angle modified to change the hole length relative to the element thickness, and thereby modify the local contribution of the holes to the resistance.

It is important to note here that a HRVA is distinct from so-called diffuser plates; the main function of a diffuser plate is to distribute the flow of electrolyte, rather than to provide significant electrical resistance. As long as 1) the flow is relatively uniform, 2) the gap sufficiently large between the wafer holder and diffuser plane, and 3) the spacing between the wafer and anode is sufficiently large (e.g., for a non-movable anode), the relative gap between a low electrical resistance diffuser and the wafer will generally only have a minor impact on the current distribution when plating a high sheet resistance wafer.

In contrast, in the case of a one-dimensional HRVA, current is prevented from flowing radially by providing a large number of small through-holes, each having very small principal dimension (or diameter for circular holes). For example, HRVAs having about 6,000 to 12,000 perforations, with each perforation having a diameter of less than about 5 mm, e.g., less than about 4 mm, less than about 3 mm, or less than about 1 mm, are suitable resistive elements. The porosity value for suitable disks is generally about 1% to 5%. Such disks increase the resistance of the plating system by about 0.3 to 1.2 ohm or more, depending on the design and electrolyte conductivity. In contrast, diffuser plates generally have openings that constitute a much larger net porosity (in the range of from 25 to 80 percent open void fraction), no more than is required to achieve a substantially uniform electrolyte flow though a significant viscous flow resistance, and generally have a much smaller, often insignificant, overall contribution to resistance of the plating system.

While a HRVA (unlike a diffuser plate) may have substantial resistivity, in some implementations the HRVA is configured such that it does not increase the system total resistance by more than about 5 ohms. While a larger system total resistance may be used, this limitation is because excessive resistance will require increased power to be used, leading to undesirable heating of the electroplating system. Also, because of some practical limitations of manufacturability (i.e., creating a large number or exceedingly small diameter holes), performance (fewer holes leading to individual-hole current "imaging"), and loss of general process utility (e.g., inability to plate thicker films without wasted power, heat and bath degradation), about 5 ohms is a practical HRVA limitation.

Another parameter of a one-dimensional resistive element is the ratio of a through-hole diameter (or other principal dimension) to the distance of the element from the wafer. It was discovered experimentally and subsequently verified by computer modeling that this ratio may be approximately 1 or less (e.g., less than about 0.8, or less than about 0.25). In some implementations, this ratio is about 0.1 for providing good plating uniformity performance. In other words, the diameter of the through-hole should be equal to or smaller than the distance from the HRVA element to the wafer. In contrast, if the through-hole diameter is larger than the wafer-to-HRVA distance, the through-hole may leave its individual current image or "footprint" on the plated layer above it, thereby leading to small scale non-uniformity in the plating. The hole diameter values recited above refer to the diameter of the through-hole opening measured on the HRVA face that is proximate to the wafer. In many implementations, the through-hole diameter on both proximate and distal faces of HRVA is the same, but it is understood that holes can also be tapered.

The distribution of current at the wafer may also depend on uniformity of the hole distribution on the HRVA. Regarding hole distribution, the holes in a HRVA plate may be designed to be of the same size and are distributed substantially uniformly. However, in some cases, such an arrangement can lead to a center spike or dip in the plated film thickness, or a corrugated (wavy) pattern. Specifically, use of a HRVA having uniform distribution of holes in the center has resulted in center spikes of about 200 Å to 300 Å for 1 micrometer plated layer.

In one implementation, a non-uniform distribution of 1-D pores/holes in the central region of the HRVA may be used to prevent the center spikes. The central region of HRVA is defined by a circular region at the HRVA center, generally within about 1 inch radius from the center of HRVA disk, or within about 15% of the wafer radius. The non-uniform distribution of through-holes effective for spike reduction can have a variety of arrangements achieved by shifting holes, adding new holes, and/or blocking holes in an otherwise uniform pattern. Various non-uniform center hole patterns may be useful for avoiding plating non-uniformity and are described in U.S. patent application Ser. No. 12/291,356, filed Nov. 7, 2008, which is herein incorporated by reference.

Structure of the Auxiliary Cathode

The auxiliary cathode 140 may be located outside of the gap created by the wafer substrate 130 and the ionically resistive ionically permeable element 135. The auxiliary cathode 140 may have may have its own electrolyte flow loop (not shown) and pump (not shown). Further details regarding configurations of the auxiliary cathode 140 are given in U.S. patent application Ser. No. 12/291,356, filed Nov. 7, 2008, and previously incorporated by reference.

In some implementations, the auxiliary cathode includes multiple segments, where each of the segments can be separately powered by a separate power supply or using one power supply having multiple channels adapted to independently power segments of the second physical cathode. Such a segmented auxiliary cathode may be useful for plating on non-circular or asymmetrical wafers, such as wafers having flat regions; some wafers contain wafer "flats", a cut out arc of the wafer at the wafer edge, used, for example, for alignment. In general, however, a segmented auxiliary cathode having independently powered segments can be used with any kind of work piece (symmetrical or not), as it allows fine-tuning plating uniformity. Specifically, a segmented auxiliary cathode can be used for providing current corrections at different azimuthal positions of the wafer.

The auxiliary cathode segments can be located below, at the same level, or above the wafer, either in the same plating chamber as the wafer or in a different plating chamber in ionic communication with the main plating chamber. Any arrangement of the segments can be used, as long as the segments are aligned with different azimuthal positions about the wafer. The number of segments can vary depending on the needs of the process. In some implementations, about 2 to 10 segments are used.

Method

Figure 5:
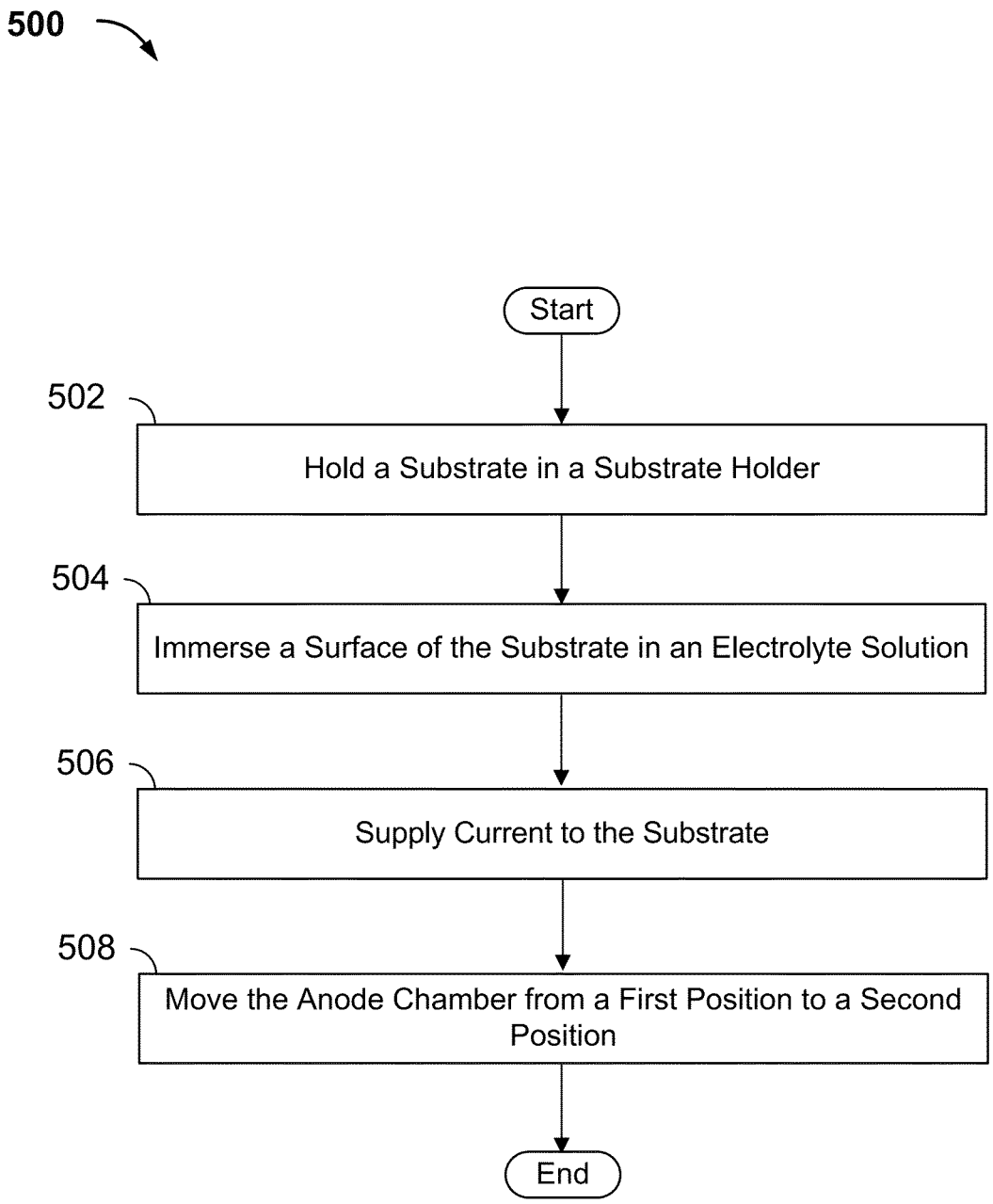
FIGS. 5 and 6 show examples of flow diagrams illustrating processes for plating a metal onto a wafer substrate.
Figure 6:
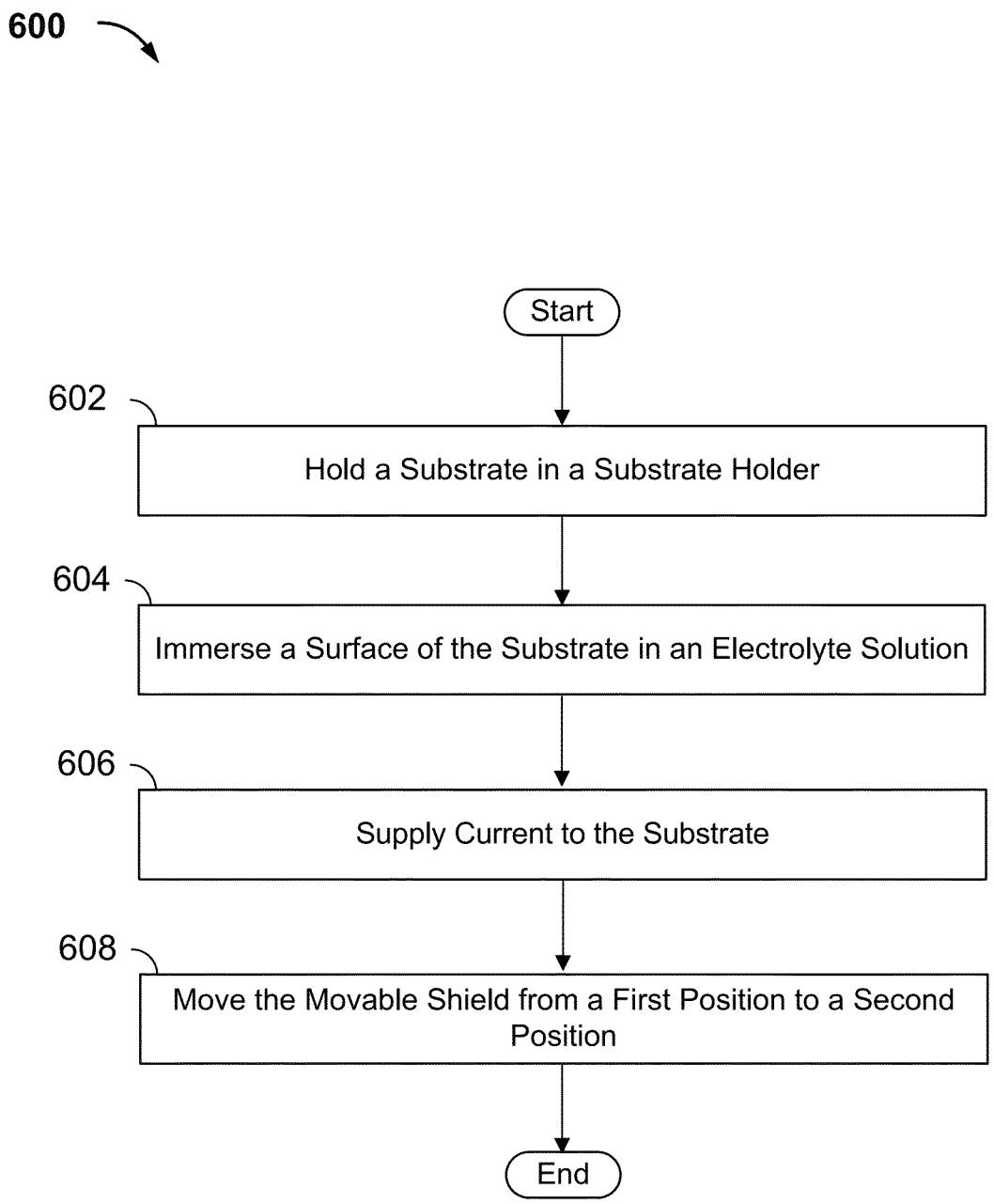

FIGS. 5 and 6 show examples of flow diagrams illustrating processes for plating a metal onto a wafer substrate. The process shown in FIG. 5 may be performed on the electroplating apparatus 100 shown in FIGS. 1A, 1B, and 2, for example. The process shown in FIG. 6 may be performed on the electroplating apparatus 300 shown in FIG. 3, for example.

The process 500 shown in FIG. 5 begins at block 502. At block 502, a substrate having a conductive seed and/or barrier layer disposed on its surface is held in a substrate holder of an apparatus. The apparatus may include a plating chamber and an anode chamber housing an anode with the plating chamber containing the anode chamber. The anode chamber may include an insulating shield oriented between the anode and an ionically resistive ionically permeable element with an opening in a central region of the insulating shield.

At block 504, the surface of the substrate is immersed in an electrolyte solution and proximate to the ionically resistive ionically permeable element positioned between the surface and the anode chamber. The electrolyte may be a plating solution for plating copper onto the substrate, for example. The ionically resistive ionically permeable element may have a flat surface that is parallel to and separated from the surface of the substrate.

At block 506, current is supplied to the substrate to plate a metal layer onto the seed and/or barrier layer. At block 508, the anode chamber is moved from a first position to a second position, with the second position being located a distance further away from the ionically resistive ionically permeable element than the first position. Moving the anode chamber from the first position to the second position may aid in obtaining a uniform current density across the surface of the substrate as metal is plated onto the seed and/or barrier layer. For example, a sheet resistance of the substrate having a conductive seed and/or barrier may be about 50 Ohms/square to about 5 Ohms/square or about 50 Ohms/square to 10 Ohms/square when the anode chamber is in the first position. As metal is plated onto the conductive seed and/or barrier, the anode chamber may be moved in a linear manner with time to the second position. In some implementations, the position of the anode chamber may be dynamically controlled during plating to account for a reduction of the voltage decrease from the edge to the center of the substrate as metal is plated onto the substrate.

In some implementations, the chamber may include an auxiliary cathode located in substantially the same plane as the substrate. Current may be supplied to the auxiliary cathode to divert a portion of ionic current from an edge region of the substrate.

Turning to FIG. 6, the process 600 shown in FIG. 6 begins at block 602. At block 602, a substrate having a conductive seed and/or barrier layer disposed on its surface is held in a substrate holder of an apparatus. The apparatus may include a plating chamber and an anode. The plating chamber may include a movable shield. The movable shield may be oriented between the anode and an ionically resistive ionically permeable element with an opening in a central region of the movable shield.

At block 604, the surface of the substrate is immersed in an electrolyte solution and proximate to the ionically resistive ionically permeable element positioned between the surface and the anode chamber. The electrolyte may be a plating solution for plating copper onto the substrate, for example. The ionically resistive ionically permeable element may have a flat surface that is parallel to and separated from the surface of the substrate.

At block 606, current is supplied to the substrate to plate a metal layer onto the seed and/or barrier layer. At block 608, the movable shield is moved from a first position to a second position, with the second position being located a distance further away from the ionically resistive ionically permeable element than the first position. Moving the movable shield from the first position to the second position may aid in obtaining a uniform current density across the surface of the substrate as metal is plated onto the seed and/or barrier layer. For example, a sheet resistance of the substrate having a conductive seed and/or barrier may be about 50 Ohms/square to 5 Ohms/square or about 50 Ohms/square to 10 Ohms/square when the movable shield is in the first position. As metal is plated onto the conductive seed and/or barrier, the movable shield may be moved in a linear manner with time to the second position. In some implementations, the position of the movable shield may be dynamically controlled during plating to account for a reduction of the voltage decrease from the edge to the center of the substrate as metal is plated onto the substrate.

In some implementations, the movable shield may include two insulating disks. Each of the insulating disks may include an opening in a central region of each disk and further include a plurality of holes in each disk. When the movable shield is in the first position, electrolyte may not be able to flow though the plurality of holes. As the movable shield moves from the first position to the second position, the orientation of the first and the second disk may change such that electrolyte is able to flow though the plurality of holes. The first and the second insulating disks of a movable shield operating in this manner may aid in obtaining a uniform current density across the surface of the substrate as metal is plated onto the seed and/or barrier layer.

In some implementations, the chamber may include an auxiliary cathode located in substantially the same plane as the substrate. Current may be supplied to the auxiliary cathode to divert a portion of ionic current from an edge region of the substrate.

Numerical Modeling

FIGS. 7-10 show examples of numerical simulations of the current density versus the radial position on a wafer substrate for different electroplating chamber configurations. These numerical simulations were performed to quantify and verify the capability of the movable anode chamber disclosed herein relative to other hardware configurations. A finite element model (using the commercial software FlexPDE™) was used for the simulations. In most cases, the model was used to predict the capability of the plating cell to generate a uniform initial current distribution on a 50 Ohms/square seed layer on a 450 mm wafer substrate.

Figure 7:
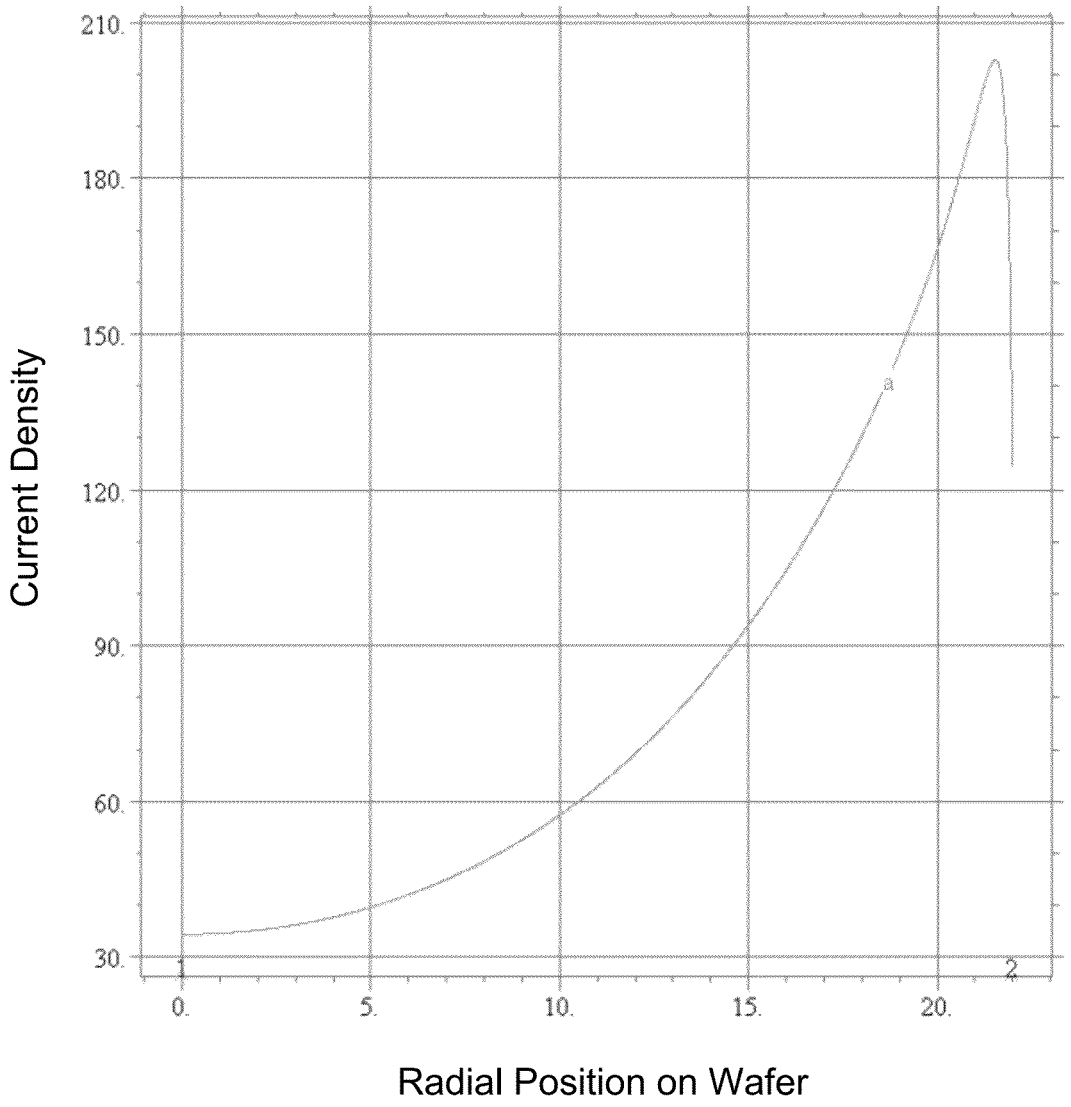
FIGS. 7-10 show examples of numerical simulations of the current density versus the radial position on a wafer for different electroplating chamber configurations.

FIG. 7 shows the current density versus radial position on the wafer substrate (i.e., 0 being the wafer substrate center and 225 being the wafer substrate edge) for a plating cell using a HRVA, a dual cathode, and a tertiary cathode. Dual and tertiary cathode configurations are further described in U.S. patent application Ser. Nos. 12/481,503 and 12/606,030, both of which are herein incorporated by reference. Such a plating cell configuration may be used in the processing of 300 mm wafer substrates, for example. FIG. 7 shows that the current density near the wafer substrate edge is about 600% higher than near the wafer substrate center, even while using settings for the dual cathode and tertiary cathode elements which reduce edge current. As a uniform current density may be needed across the wafer substrate during initial plating when small features are to be filled by the copper which is being electrodeposited, this plating cell configuration would not be used in such processes. Such a plating cell configuration, however, can generate a uniform profile on thick copper films.

Figure 8:
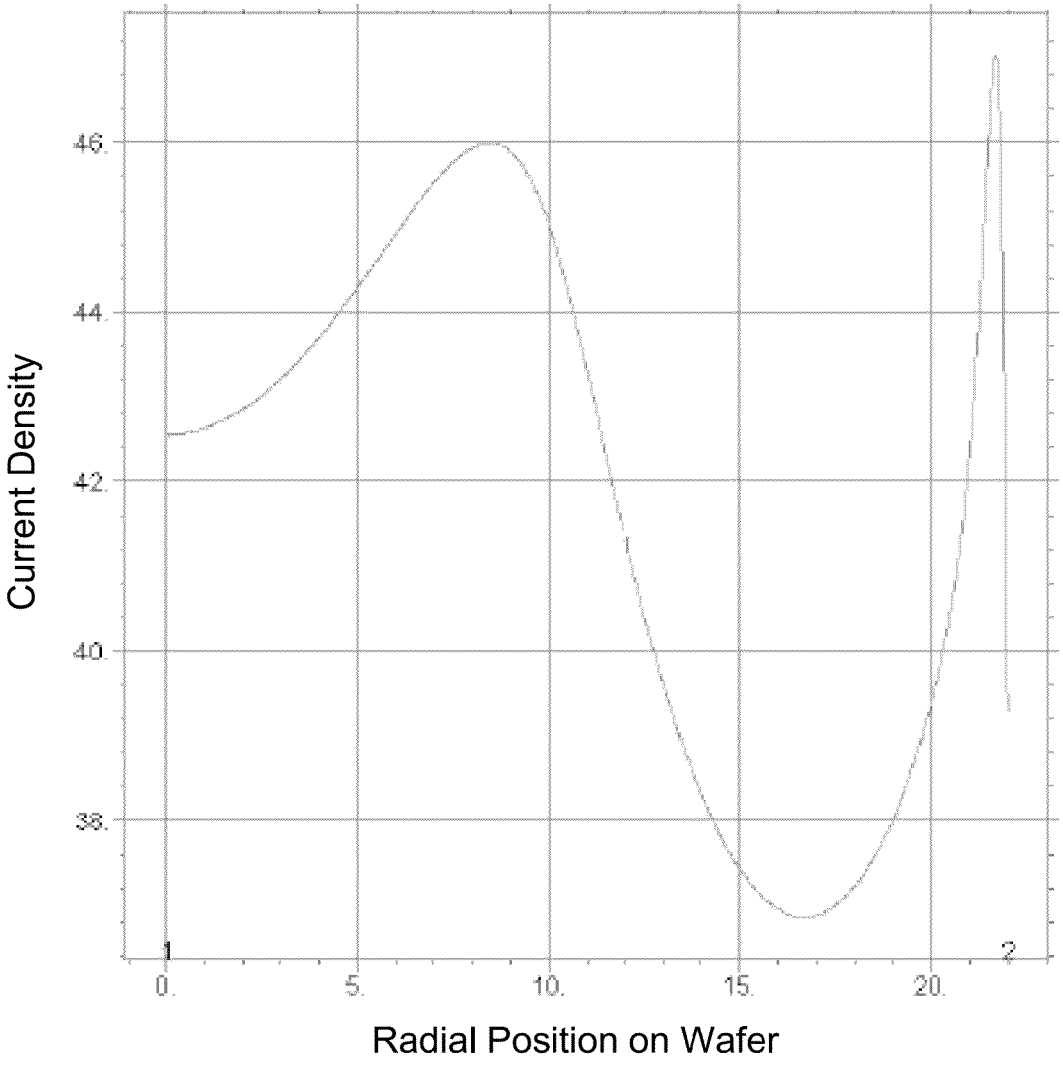

An example of a current distribution generated using the disclosed apparatus having a movable anode chamber, with the movable anode chamber being at its upper position, is shown in FIG. 8. For this model, the anode chamber opening was 210 mm. At the 105 mm radial position, an insulating shield extended upward about 14 mm toward a HRVA plate. From that position, the insulating shield extended outward to a position about 4 mm below the outer perimeter of the HRVA plate. The HRVA plate was 1.17% porous, had an outer opening diameter of 223.5 mm, and was 5 mm below the wafer substrate.

Starting at the wafer substrate center, the initial current density increased due to the terminal effect across the inner 85 mm radius of the wafer substrate above the anode chamber. Current density out to a radial position about 170 mm from the wafer substrate center dropped, however, due to the shielding effect of the sloped insulating shield. At radii from about 170 mm to 215 mm, the current density increased due to the much stronger terminal effect at the outer portion of the wafer substrate where a higher current flow across the seed layer is required. Beyond 215 mm, the dual cathode effectively reduced the current density. The overall current distribution varied by about 25%, better than the 600% variation typical with existing hardware scaled to 450 mm wafer substrate use (see FIG. 7). As noted above, parameters such as the insulating shield opening diameter, the slope of the insulating shield, the distance between the insulating shield and the HRVA plate, the distance between the HRVA plate and the wafer substrate, the HRVA plate percent open area or thickness, and the dual cathode strength can be used to adjust the current distribution when plating begins on a thin resistive seed layer.

Figure 9:
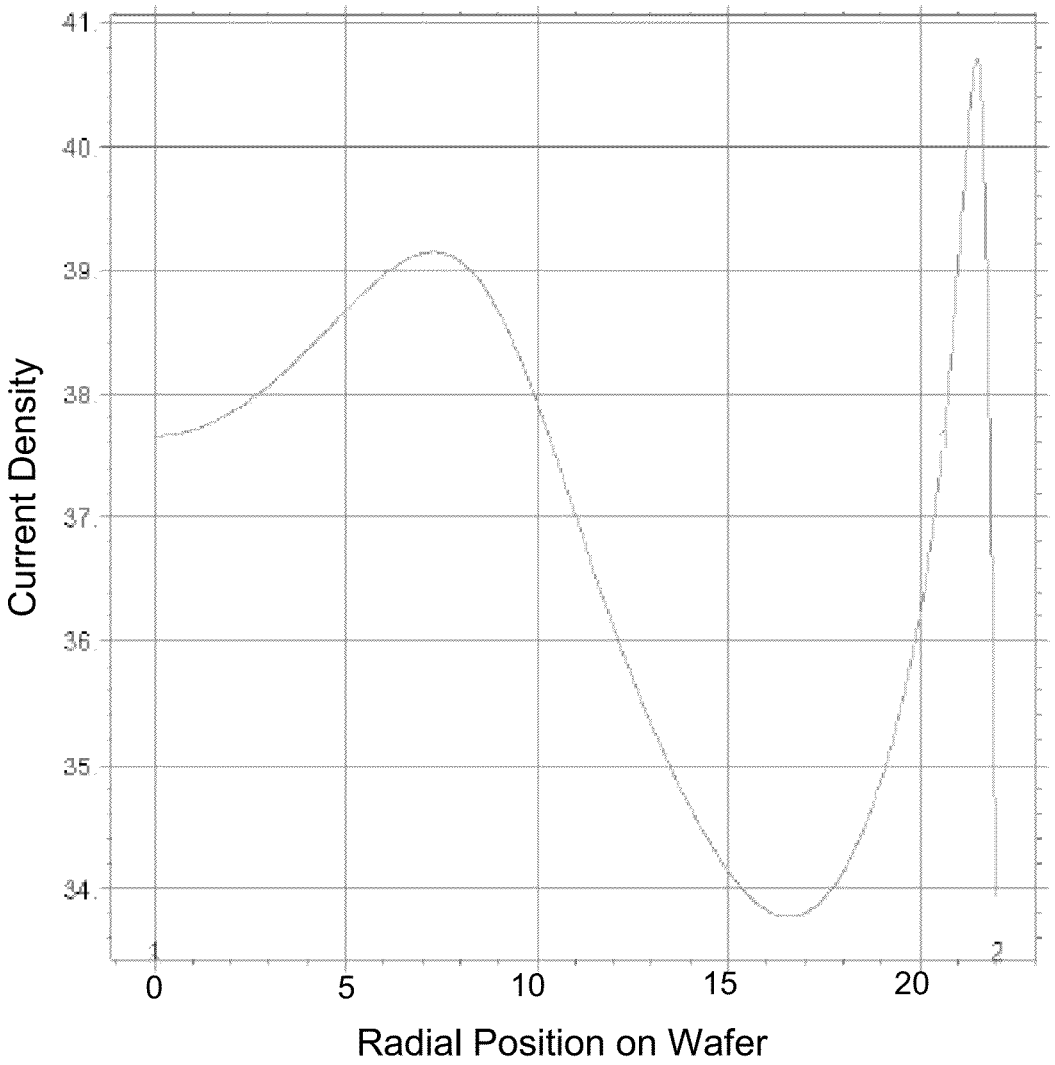

An example of a current distribution generated using another configuration of the disclosed apparatus having a movable anode chamber, with the movable anode chamber being at its upper position, is shown in FIG. 9. For this model, the spacing between the outer part of the HRVA plate and the outer part of the anode chamber was increased to 8 mm, which allowed for a membrane and solution entry point to be positioned between the HRVA plate and the anode chamber. A more complex shape of the insulating shield was also used. As shown in FIG. 9, the overall current distribution varied by about 21%.

Figure 10:
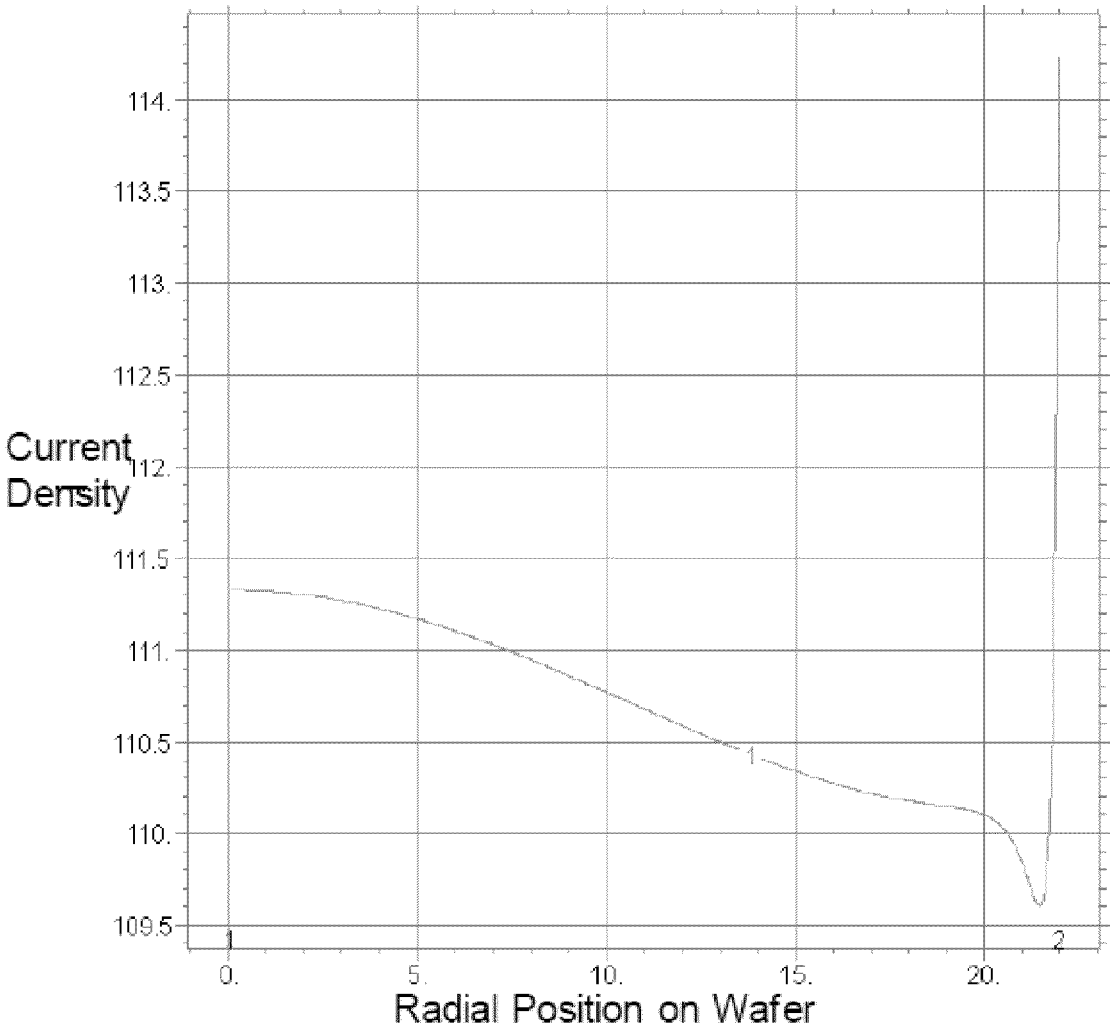

As described above, after copper is plated onto the seed layer and the terminal effect becomes less pronounced, the movable anode chamber may be moved to a lower position to generate a uniform current distribution across the face of the wafer substrate. FIG. 10 shows an example a current distribution generated using a model in which the anode chamber was in a lower position (e.g., about 20 cm from its upper position) and the copper layer on the wafer substrate was 0.4 micrometers thick. As shown, the overall current distribution varied about varied by about 3%.

Thus, as these numerical simulations illustrate, a movable anode chamber may be used (in combination with other techniques) to effectively mitigate the terminal effect. Further, after a metal is plated onto a thin resistive seed layer, a movable anode chamber, positioned such that current flow to the wafer substrate edge is not impeded, may still provide a uniform current density across the face of a wafer substrate.

Further Implementations

The apparatus/methods described hereinabove also may be used in conjunction with lithographic patterning tools or processes, for example, for the fabrication or manufacture of semiconductor devices, displays, LEDs, photovoltaic panels, and the like. Typically, though not necessarily, such tools/processes will be used or conducted together in a common fabrication facility. Lithographic patterning of a film typically comprises some or all of the following steps, each step enabled with a number of possible tools: (1) application of photoresist on a work piece, i.e., substrate, using a spin-on or spray-on tool; (2) curing of photoresist using a hot plate or furnace or UV curing tool; (3) exposing the photoresist to visible or UV or x-ray light with a tool such as a wafer stepper; (4) developing the photoresist so as to selectively remove photoresist and thereby pattern it using a tool such as a wet bench; (5) transferring the photoresist pattern into an underlying film or work piece by using a dry or plasma-assisted etching tool; and (6) removing the photoresist using a tool such as an RF or microwave plasma resist stripper.

It is understood that the examples and implementations described herein are for illustrative purposes only and that various modifications or changes in light thereof will be suggested to persons skilled in the art. Although various details have been omitted for clarity's sake, various design alternatives may be implemented. Therefore, the present examples are to be considered as illustrative and not restrictive, and the disclosed implementations are not to be limited to the details given herein, but may be modified within the scope of the appended claims. Further it is understood that many features presented in this application can be practiced separately as well as in any suitable combination with each other, as will be understood by one of ordinary skill in the art.

What is claimed is:

1. An apparatus comprising:

(a) a plating chamber configured to contain an electrolyte while electroplating metal onto a substrate;

(b) a substrate holder configured to hold the substrate and having one or more electrical power contacts arranged to contact an edge of the substrate and to provide electrical current to the substrate during electroplating;

(c) an ionically resistive ionically permeable element positioned between the substrate and an anode chamber during electroplating, the ionically resistive ionically permeable element having a flat surface that is substantially parallel to and separated from a plating face of the substrate; and (d) the anode chamber housing an anode, the anode chamber being movable with respect to the ionically resistive ionically permeable element to vary a distance between the anode chamber and the ionically resistive ionically permeable element during electroplating, the anode chamber including an insulating shield oriented between the anode and the ionically resistive ionically permeable element, wherein the insulating shield includes an outer perimeter and an inner perimeter, the inner perimeter of the insulating shield defining an opening in a central region of the insulating shield, and wherein a surface of the insulating shield includes a slope such that the outer perimeter is closer to the ionically resistive ionically permeable element than the inner perimeter, wherein the anode chamber includes a cationic membrane in the opening of the insulating shield.

2. The apparatus of claim 1, further comprising a catholyte chamber, wherein the catholyte chamber includes a volume of the plating chamber not occupied by the anode chamber.

3. The apparatus of claim 1, wherein an area of the opening in the insulating shield is about 10% to 30% of an area of the plating face of the substrate.

4. The apparatus of claim 1, wherein positions of the anode chamber include an upper position, and wherein when the anode chamber is in the upper position, the outer perimeter of the insulating shield is about 1 millimeter to 10 millimeters from the ionically resistive ionically permeable element and the inner perimeter of the insulating shield is about 3 millimeters to 50 millimeters from the ionically resistive ionically permeable element.

5. The apparatus of claim 1, wherein the distance between the anode chamber and the ionically resistive ionically permeable element may be varied by about 2 centimeters to 20 centimeters.

6. The apparatus of claim 1, wherein the ionically resistive ionically permeable element has an ionically resistive body with a plurality of perforations made in the body such that the perforations do not form communicating channels within the body, wherein said perforations allow for transport of ions through the element, and wherein substantially all of the perforations have a principal dimension or a diameter of the opening on the surface of the element facing the surface of the substrate of no greater than about 5 millimeters.

7. The apparatus of claim 1, wherein the flat surface of the ionically resistive ionically permeable element is separated from the plating face of the substrate by a gap of about 1 millimeter to 8 millimeters during electroplating.

8. The apparatus of claim 1, further comprising an auxiliary cathode located in substantially the same plane as the substrate during electroplating, and adapted for diverting a portion of ionic current from an edge region of the substrate.

9. The apparatus of claim 8, wherein the auxiliary cathode is located peripheral to the substrate holder and radially outward of a peripheral gap between the ionically resistive ionically permeable element and the substrate holder.

10. The apparatus of claim 1, further comprising:

a control circuit designed or configured to control the distance between the anode chamber and the ionically resistive ionically permeable element in a manner that produces a uniform current distribution from the anode at the plating face of the substrate.

11. The apparatus of claim 1, further comprising:

a control circuit designed or configured to position the anode chamber at a first distance from the ionically resistive ionically permeable element when electroplating the metal begins, and to move the anode chamber to a second distance from the ionically resistive ionically permeable element as the metal is electroplated onto the substrate, the first distance being less than the second distance.

12. The apparatus of claim 11, wherein a distance between the first distance and the second distance is about 2 centimeters to about 20 centimeters.

13. The apparatus of claim 1, further comprising:

a control circuit designed or configured to position the anode chamber at an upper position when a sheet resistance of the substrate is about 50 Ohms per square to 5 Ohms per square.

14. The apparatus of claim 1, further comprising:

a control circuit designed or configured to linearly move the anode chamber with time as the metal is electroplated onto the substrate.

15. The apparatus of claim 1, further comprising:

a controller comprising program instructions for conducting a process comprising the operations of:

(a) immersing the plating face of the substrate held in the substrate holder in the electrolyte, the substrate having a conductive seed and/or barrier layer disposed on the plating face;

(b) supplying current to the substrate to plate the metal onto the seed and/or barrier layer; and (c) moving the anode chamber from a first position to a second position, the second position being located a distance farther away from the ionically resistive ionically permeable element than the first position.

16. A system comprising the apparatus of claim 1 and a stepper.

17. The apparatus of claim 1, wherein the slope of the insulating shield varies such that the slope is at a first angle near the center region of the insulating shield and a second angle near an edge region of the insulating shield, the first and second angles being measured based on a horizontal plane, the second angle being smaller than the first angle such that the slope is shallower in the edge region of the insulating shield.

18. An apparatus comprising:

(a) a plating chamber configured to contain an electrolyte while electroplating metal onto a substrate;

(b) a substrate holder configured to hold the substrate and having one or more electrical power contacts arranged to contact an edge of the substrate and to provide electrical current to the substrate during electroplating;

(c) an ionically resistive ionically permeable element positioned between the substrate and an anode chamber during electroplating, the ionically resistive ionically permeable element having a flat surface that is substantially parallel to and separated from a plating face of the substrate; and (d) the anode chamber housing an anode, the anode chamber being movable with respect to the ionically resistive ionically permeable element to vary a distance between the anode chamber and the ionically resistive ionically permeable element during electroplating, the anode chamber including an insulating shield oriented between the anode and the ionically resistive ionically permeable element, wherein the insulating shield includes an outer perimeter and an inner perimeter, the inner perimeter of the insulating shield defining an opening in a central region of the insulating shield, and wherein a surface of the insulating shield includes a slope such that the outer perimeter is closer to the ionically resistive ionically permeable element than the inner perimeter, wherein the slope of the insulating shield varies such that the slope is at a first angle near the center region of the insulating shield and a second angle near an edge region of the insulating shield, the first and second angles being measured based on a horizontal plane, the second angle being smaller than the first angle such that the slope is shallower in the edge region of the insulating shield.

19. The apparatus of claim 18, wherein an area of the opening in the insulating shield is about 10% to 30% of an area of the plating face of the substrate.

20. The apparatus of claim 18, wherein positions of the anode chamber include an upper position, and wherein when the anode chamber is in the upper position, the outer perimeter of the insulating shield is about 1 millimeter to 10 millimeters from the ionically resistive ionically permeable element and the inner perimeter of the insulating shield is about 3 millimeters to 50 millimeters from the ionically resistive ionically permeable element.

21. The apparatus of claim 18, wherein the distance between the anode chamber and the ionically resistive ionically permeable element may be varied by about 2 centimeters to 20 centimeters.

22. The apparatus of claim 18, wherein the ionically resistive ionically permeable element has an ionically resistive body with a plurality of perforations made in the body such that the perforations do not form communicating channels within the body, wherein said perforations allow for transport of ions through the element, and wherein substantially all of the perforations have a principal dimension or a diameter of the opening on the surface of the element facing the surface of the substrate of no greater than about 5 millimeters.

23. The apparatus of claim 18, wherein the flat surface of the ionically resistive ionically permeable element is separated from the plating face of the substrate by a gap of about 1 millimeter to 8 millimeters during electroplating.

24. The apparatus of claim 18, further comprising an auxiliary cathode located in substantially the same plane as the substrate during electroplating, and adapted for diverting a portion of ionic current from an edge region of the substrate.

25. The apparatus of claim 24, wherein the auxiliary cathode is located peripheral to the substrate holder and radially outward of a peripheral gap between the ionically resistive ionically permeable element and the substrate holder.

26. The apparatus of claim 18, further comprising:

a control circuit designed or configured to control the distance between the anode chamber and the ionically resistive ionically permeable element in a manner that produces a uniform current distribution from the anode at the plating face of the substrate.

27. The apparatus of claim 18, further comprising:

a control circuit designed or configured to position the anode chamber at a first distance from the ionically resistive ionically permeable element when electroplating the metal begins, and to move the anode chamber to a second distance from the ionically resistive ionically permeable element as the metal is electroplated onto the substrate, the first distance being less than the second distance.

28. The apparatus of claim 27, wherein a distance between the first distance and the second distance is about 2 centimeters to about 20 centimeters.

29. The apparatus of claim 18, further comprising:

a control circuit designed or configured to position the anode chamber at an upper position when a sheet resistance of the substrate is about 50 Ohms per square to 5 Ohms per square.

30. The apparatus of claim 18, further comprising:

a control circuit designed or configured to linearly move the anode chamber with time as the metal is electroplated onto the substrate.

31. The apparatus of claim 18, further comprising:

a controller comprising program instructions for conducting a process comprising the operations of:

(a) immersing the plating face of the substrate held in the substrate holder in the electrolyte, the substrate having a conductive seed and/or barrier layer disposed on the plating face;

(b) supplying current to the substrate to plate the metal onto the seed and/or barrier layer; and (c) moving the anode chamber from a first position to a second position, the second position being located a distance farther away from the ionically resistive ionically permeable element than the first position.

32. A method comprising:

(a) holding a substrate having a conductive seed and/or barrier layer disposed on its surface in a substrate holder of an apparatus, the apparatus including a plating chamber and an anode chamber housing an anode, the plating chamber containing the anode chamber, the anode chamber including an insulating shield oriented between the anode and an ionically resistive ionically permeable element, wherein the insulating shield includes an outer perimeter and an inner perimeter, the inner perimeter of the insulating shield defining an opening in a central region of the insulating shield, and wherein a surface of the insulating shield includes a slope such that the outer perimeter is closer to the ionically resistive ionically permeable element than the inner perimeter, wherein the anode chamber includes a cationic membrane in the opening of the insulating shield;

(b) immersing the surface of the substrate in an electrolyte solution and proximate the ionically resistive ionically permeable element positioned between the surface of the substrate and the anode chamber, the ionically resistive ionically permeable element having a flat surface that is parallel to and separated from the surface of the substrate;

(c) supplying current to the substrate to plate a metal layer onto the seed and/or barrier layer; and (d) moving the anode chamber from a first position to a second position, the second position being located a distance farther away from the ionically resistive ionically permeable element than the first position.

33. The method of claim 32, further comprising dynamically controlling the position of the anode chamber during plating to account for a reduction of a voltage decrease from an edge to a center of the surface of the substrate.

34. The method of claim 32, wherein an area of the opening in the insulating shield is about 10% to 30% of an area of the surface of the substrate.

35. The method of claim 32, wherein a sheet resistance of the substrate having a conductive seed and/or barrier is about 50 Ohms per square to 5 Ohms per square when the anode chamber is in the first position.

36. The method of claim 32, wherein the anode chamber linearly moves from the first position to the second position in a period of time.

37. The method of claim 32, further comprising:

supplying current to an auxiliary cathode located in substantially the same plane as the substrate and thereby diverting a portion of ionic current from an edge region of the substrate.

38. The method of claim 32, further comprising:

applying photoresist to the substrate;

exposing the photoresist to light;

patterning the photoresist and transferring the pattern to the substrate; and selectively removing the photoresist from the substrate.

* * * * *